US010170235B2

(12) United States Patent
Misaki et al.

(10) Patent No.: US 10,170,235 B2
(45) Date of Patent: Jan. 1, 2019

(54) REACTOR

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Takashi Misaki, Yokkaichi (JP); Kouji Nishi, Yokkaichi (JP); Shinichirou Yamamoto, Yokkaichi (JP); Masayuki Kato, Yokkaichi (JP); Yukinori Yamada, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 198 days.

(21) Appl. No.: 15/101,943

(22) PCT Filed: Dec. 25, 2014

(86) PCT No.: PCT/JP2014/084435
§ 371 (c)(1),
(2) Date: Jun. 6, 2016

(87) PCT Pub. No.: WO2015/099099
PCT Pub. Date: Jul. 2, 2015

(65) Prior Publication Data

US 2016/0314897 A1 Oct. 27, 2016

(30) Foreign Application Priority Data

Dec. 26, 2013 (JP) ..... 2013-270519
May 20, 2014 (JP) ..... 2014-104773

(51) Int. Cl.
*H01F 27/29* (2006.01)
*H01F 27/24* (2006.01)
(Continued)

(52) U.S. Cl.
CPC ..... *H01F 27/29* (2013.01); *H01F 27/24* (2013.01); *H01F 27/2823* (2013.01);
(Continued)

(58) Field of Classification Search
CPC ..... H01F 27/29; H01F 27/2823; H01F 27/24; H01F 27/2828; H01F 27/263;
(Continued)

(56) References Cited

U.S. PATENT DOCUMENTS

2011/0156853 A1* 6/2011 Kato ..... H01F 27/306 336/192
2012/0194311 A1* 8/2012 Suzuki ..... H01F 27/266 336/92
(Continued)

FOREIGN PATENT DOCUMENTS

JP 2011-049494 A 3/2011
JP 2012-169425 A * 9/2012
(Continued)

OTHER PUBLICATIONS

Mar. 3, 2015 Search Report issued in International Patent Application No. PCT/JP2014/084435.

*Primary Examiner* — Mang Tin Bik Lian
(74) *Attorney, Agent, or Firm* — Oliff PLC

(57) ABSTRACT

Provided is a reactor that enables an end portion of a wire forming a coil to be accurately connected to a terminal fitting and that also has excellent assemblability. A reactor includes a coil formed by winding a wire and a magnetic core having a portion disposed inside the coil, wherein the magnetic core includes a terminal-equipped outer core component, the
(Continued)

terminal-equipped outer core component including a side main portion protruding from the coil and constituting a magnetic circuit, a terminal fitting connected to an end portion of the wire, and a side resin-molded portion integrally holding the side main portion and the terminal fitting.

6 Claims, 13 Drawing Sheets

(51) Int. Cl.
*H01F 27/30* (2006.01)
*H01F 37/00* (2006.01)
*H01F 27/28* (2006.01)
*H01F 27/26* (2006.01)

(52) U.S. Cl.
CPC ..... *H01F 27/2828* (2013.01); *H01F 37/00* (2013.01); *H01F 27/263* (2013.01); *H01F 27/306* (2013.01)

(58) Field of Classification Search
CPC ..... H01F 27/306; H01F 27/10; H01F 27/26; H01F 27/2847; H01F 3/14; H01F 5/04; H01F 2005/043; H01F 2005/046
USPC ..... 336/192, 212, 208, 199, 178, 182, 184
See application file for complete search history.

(56) References Cited

U.S. PATENT DOCUMENTS

2013/0182478 A1* 7/2013 Nomura ..... H01F 27/022
363/123
2013/0293335 A1* 11/2013 Yoshikawa ..... H01F 27/02
336/192
2015/0162119 A1* 6/2015 Nakatsu ..... H01F 27/306
336/105

FOREIGN PATENT DOCUMENTS

JP 2012-169425 A 9/2012
JP 2012-209333 A 10/2012
JP 2013-098253 A 5/2013
JP 2013-179184 A 9/2013
WO WO 2012/039268 A1 * 3/2012

* cited by examiner

3:328B, 320, 310, 310
10:2, 3

REACTOR

TECHNICAL FIELD

Aspect of the present disclosure relate to a reactor used for a constituent component of a power conversion device such as an in-vehicle DC-DC converter installed in a vehicle such as a hybrid automobile, and particularly relates to a reactor that enables a coil to be accurately connected to a terminal fitting and that also has excellent assemblability.

BACKGROUND ART

One of the components of a circuit that increases/decreases the voltage is a reactor. Patent Documents 1 and 2 disclose a reactor used for a converter installed in a vehicle such as a hybrid automobile. Patent Document 1 discloses that a covered body obtained by covering the entire circumference of a combination of a coil formed by winding a wire into a helical shape and a ring-shaped magnetic core with a resin is immersed in a liquid coolant to enhance heat dissipation properties. Patent Document 2 discloses that a coil molded component obtained by covering a coil formed by winding a wire into a helical shape with a resin makes it easy to handle the coil and to perform the operation of assembling the coil to a magnetic core and that a core molded component obtained by covering a portion of the magnetic core that protrudes from the coil with a resin makes it possible to protect the protruding portion and the coil using the resin.

The coil is connected to an external device such as a power supply that supplies power. To electrically connect the coil and the external device to each other, conventionally, a terminal fitting is connected to an end portion of the wire forming the coil. Patent Document 2 discloses a terminal block including a terminal fitting. This terminal block is a resin molded component in which a portion of the terminal fitting is embedded in an insulating resin, and includes a fixing portion (seat) formed of the insulating resin so that the terminal block is stably fixed to the magnetic core (the core molded component).

CITATION LIST

Patent Document

Patent Document 1: JP 2011-049494A
Patent Document 2: JP 2013-179184A

SUMMARY

Technical Problem

There is a demand for a reactor that enables an end portion of a wire forming a coil to be accurately connected to a terminal fitting and that furthermore has excellent assemblability.

If a resin molded component including a terminal fitting like the above-described terminal block is used, the terminal fitting can be easily and stably disposed in the vicinity of the end portion of the wire forming the coil. Therefore, the configuration that uses the terminal block makes it easier to stabilize a connecting portion between the end portion of the wire and the terminal fitting when compared with a case where, for example, a round terminal (terminal 50 in FIG. 3 of Patent Document 1) having a round hole into which a bolt is inserted is used. However, if the above-described terminal block is used, there are cases where the end portion of the wire cannot be accurately connected to the terminal fitting.

Here, resin molded bodies generally have tolerances. For this reason, when a large amount of deviation of dimensions of the terminal block occurs within a tolerance range, there is a risk that the position of the end portion of the wire forming the coil and the position of the terminal fitting of the terminal block may be displaced. If the end portion of the wire and the terminal fitting of the terminal block are aligned by, for example, pulling the end portion of the wire, there is a risk that unwanted stress may be applied to the vicinity of a connecting portion at the end portion of the wire to which the terminal fitting is connected, leading to a poor connection. Thus, if the terminal block is used, in some cases it is difficult to correct the displacement during the above-described alignment. In the case where, in addition to the terminal block, a plurality of resin molded bodies, such as the core molded component and the coil molded component described above, are used, the above-described displacement is likely to occur, and correction of this displacement is considered to be even more difficult.

Thus, an object of preferred embodiments is to provide a reactor that enables a coil to be accurately connected to a terminal fitting and that also has excellent assemblability.

Solution to Problem

A reactor according to an aspect of some preferred embodiments is a reactor including a coil formed by winding a wire and a magnetic core having a portion disposed inside the coil, wherein the magnetic core includes a terminal-equipped outer core component, the terminal-equipped outer core component including a side main portion protruding from the coil and constituting a magnetic circuit, a terminal fitting connected to an end portion of the wire, and a side resin-molded portion integrally holding the side main portion and the terminal fitting.

The above-described reactor enables the coil to be accurately connected to the terminal fitting and also has excellent assemblability.

DESCRIPTION OF EMBODIMENTS

Figure 1:
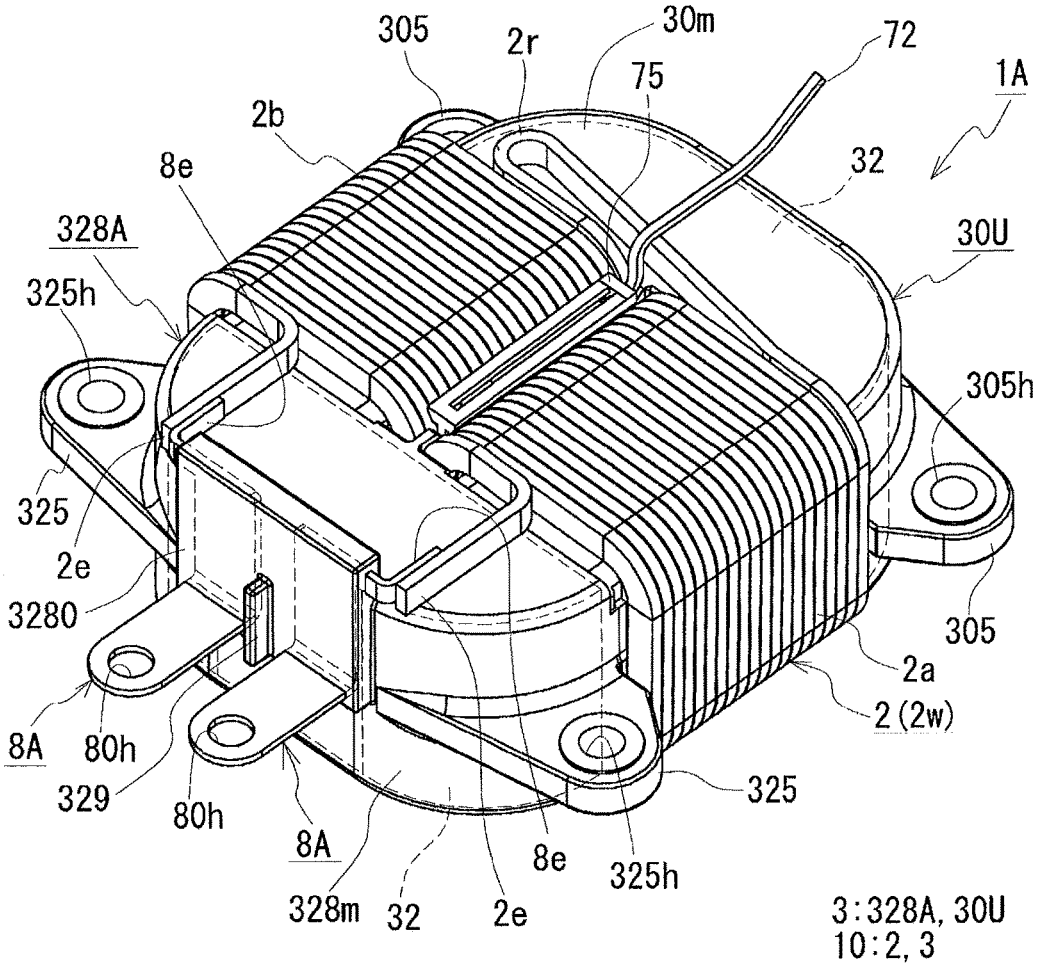
FIG. 1 is a schematic perspective view showing a reactor of Embodiment 1.

First, embodiments of the present invention will be listed and described.

(1) A reactor according to an aspect of a preferred embodiments includes a coil formed by winding a wire and a magnetic core having a portion disposed inside the coil, wherein the magnetic core includes a terminal-equipped outer core component, the terminal-equipped outer core component including a side main portion protruding from the coil and constituting a magnetic circuit, a terminal fitting connected to an end portion of the wire, and a side resin-molded portion integrally holding the side main portion and the terminal fitting.

"The side resin-molded portion holding the terminal fitting" means that, with respect to the side main portion, the terminal fitting is directly supported by a resin of the side resin-molded portion. The terminal fitting is held by the side resin-molded portion by a portion of the resin of the side resin-molded portion being bonded to a portion of the terminal fitting (e.g., a configuration (3), which will be described later), covering a portion of the terminal fitting (e.g., a configuration (5), which will be described later), or latching a portion of the terminal fitting, for example.

In the reactor according to the above-described aspect, at least a portion of those portions of the magnetic core that form a magnetic circuit is a molded component (outer core component) covered with a resin. Also, in the reactor according to the above-described aspect, a configuration is adopted in which the terminal fitting is not a resin molded component (terminal block) independent of the portions forming the magnetic circuit, but the terminal fitting and a portion of the above-described magnetic core are integrated into one piece by a resin-molded portion. That is to say, the terminal fitting is directly supported by the resin itself which the side resin-molded portion that covers at least a portion of the side main portion is composed of. With this configuration, the reactor according to the above-described aspect can suppress displacement due to a tolerance of the aforementioned resin molded component and enables the end portion of the wire forming the coil to be accurately connected to the terminal fitting.

Moreover, with the reactor according to the above-described aspect, the terminal fitting included in the terminal-equipped outer core component can be easily and accurately disposed in the vicinity of the end portion of the wire forming the coil, by assembling the coil and the magnetic core together and thereby forming the magnetic core in a predetermined shape. Since the end portion of the above-described wire and the terminal fitting can be accurately arranged, the reactor according to the above-described aspect can save the time taken to position the end portion of the wire and the terminal fitting. In the case where the side main portion and the terminal fitting are integrally molded into an integrated body by the resin of the side resin-molded portion, the terminal fitting or the terminal block is independent of the coil and the portions forming the magnetic circuit, and thus, when compared with a conventional reactor manufactured by performing formation of the magnetic circuit portions and arrangement of the terminal fitting and the like as separate steps, the number of components is small even though the terminal fitting is provided, and the number of manufacturing steps is small. From these points, the reactor according to the above-described aspect has excellent assemblability and hence excellent productivity.

In addition, with the reactor according to the above-described aspect, since the side main portion is covered by the side resin-molded portion, mechanical protection, protection from the environment, improvement in the insulation from the coil, improvement in the insulation from the terminal fitting, and the like can be achieved.

(2) As an example of the above-described reactor, in one configuration, the terminal-equipped outer core component may include a fixing portion that is formed of a resin of the side resin-molded portion and that holds the terminal fitting, and the fixing portion may include a shaft portion that is inserted into at least one fixing hole provided in the terminal fitting and a head portion that extends continuous with the shaft portion and that has a portion larger than a minimum diameter of the fixing hole.

In this configuration, typically, the shaft portion and the head portion that are composed of the resin of the side resin-molded portion function as a rivet, and the terminal fitting is riveted. With this configuration, this configuration allows the terminal fitting to be firmly held by the side resin-molded portion. The terminal-equipped outer core component included in this configuration can be easily manufactured typically by forming only the shaft portion during molding of the side resin-molded portion, melting an end portion of the shaft portion in a state in which the shaft portion is inserted into the fixing hole of the terminal fitting, and forming the head portion using this melted portion. 4 side resin-molded portion that has been molded does not include the terminal fitting and thus has a relatively simple external shape, and therefore, an intermediate component (molded component before fixation of the terminal fitting) has excellent ease of manufacture.

(3) In the case where the above-described fixing portion includes at least one shaft portion and head portion, in one configuration, the terminal-equipped outer core component may further include a rotation preventing portion that is formed of the resin of the side resin-molded portion and that prevents the terminal fitting from rotating.

If the fixing hole used for riveting in the above-described configuration (2) is a cylindrical hole, although the fixing hole is easy to form, there is a risk that the terminal fitting may rotate about the shaft portion. If the terminal fitting rotates, there is a risk that the positions of the end portion of the wire of the coil and the terminal fitting may be displaced. Since the present configuration further includes the rotation preventing portion, the above-described displacement due to rotation of the terminal fitting can be prevented even when the fixing hole is a cylindrical hole. If a protrusion or the like to be fitted into another hole provided in the terminal fitting, for example, is formed as the rotation preventing portion, the rotation preventing portion also functions as the above-described fixing portion for the terminal fitting, and it is thus easy to enhance the strength of fixation of the terminal fitting.

(4) As an example of the above-described reactor, in one configuration, the terminal-equipped outer core component may include an embedding and fixing portion which is formed of a resin of the side resin-molded portion and in which a portion of the terminal fitting is embedded and held.

In this configuration, a portion of the terminal fitting is embedded in the resin of the side resin-molded portion and is thus firmly held. Since the terminal-equipped outer core component included in this configuration typically is an integrated body in which the side main portion and the terminal fitting are integrally molded with the side resin-molded portion, the necessity for separately performing fixation of the terminal fitting is eliminated, and thus the number of steps is small.

(5) As an example of the above-described reactor, in one configuration, the magnetic core may form a ring-shaped closed magnetic circuit constituted by a pair of middle main portions that are disposed inside the coil, the side main portion that connects one end of one of the middle main portions to one end of the other middle main portion, and another side main portion that protrudes from the coil and connects another end of one of the middle main portions to another end of the other middle main portion, and the magnetic core may further include a connecting resin-molded portion that covers at least a portion of the other side main portion and the pair of middle main portions and that integrally holds these main portions.

In this configuration, the magnetic core has the two main constituent components, namely, the terminal-equipped outer core component and a core component into which the side main portion and the pair of middle main portions are integrated by the connecting resin-molded portion. Thus, the number of components is small, and the magnetic core can be easily assembled into a ring shape. Moreover, in this configuration, assembly of the coil and the magnetic core can be easily performed by connecting the two core components to each other in a state in which the coil is supported by the core component including the connecting resin-molded portion, and thus the assemblability is excellent. Furthermore, since this configuration includes the connecting resin-molded portion, the insulation between the middle main portion and the coil can be enhanced, and mechanical protection and protection from the environment can also be achieved.

(6) As an example of the above-described reactor, in one configuration, the magnetic core may form a ring-shaped closed magnetic circuit constituted by a pair of middle main portions that are disposed inside the coil, the side main portion that connects one end of one of the middle main portions to one end of the other middle main portion, and another side main portion that protrudes from the coil and connects another end of one of the middle main portions to another end of the other middle main portion, and the magnetic core may further include an outer core component and an inner core component below. The outer core component includes the other side main portion and a side resin-molded portion that covers at least a portion of the other side main portion. The inner core component includes the middle main portion and a middle resin-molded portion that covers at least a portion of the middle main portion.

The outer core component included in this configuration is, so to speak, the above-described terminal-equipped outer core component from which the terminal fitting has been omitted. In this configuration, the magnetic core has a total of four main constituent components, namely, the terminal-equipped outer core component, the outer core component, and a pair of the inner core components. Thus, when the terminal fitting is included, the number of assembled components is smaller than that of conventional reactors disclosed in Patent Document 2 and the like, resulting in excellent assemblability. Moreover, in this configuration, each core component can have a simple shape such as a rectangular parallelepiped shape, and is thus easy to form, resulting in excellent ease of manufacture. Furthermore, in this configuration, the middle resin-molded portion is provided, and thus the insulation between the middle main portion and the coil can be enhanced. In addition, in this configuration, since all of the core components include the resin-molded portions, mechanical protection and protection from the environment can also be achieved.

(7) As an example of the above-described reactor, in one configuration, a junction layer disposed on an installation surface of the coil may be provided.

In this configuration, for example, the coil can be easily fixed to an installation target using the junction layer, and hence the reactor can be fixed to the installation target. Thus, the ease of installation is excellent. Due to this fixation of the coil, even when the coil is subjected to vibration or the like during use of the reactor, this configuration enables prevention of behaviors such as elongation/contraction of the coil or rubbing of the turns of the coil against each other. Furthermore, due to the above-described fixation of the coil, the heat of the coil is easily transferred to the installation target, or to a heat dissipation plate, which will be described later, if provided, and thus, this configuration also has excellent heat dissipation properties.

Hereinafter, reactors according to embodiments will be specifically described with reference to the drawings. In the drawings, like reference numerals denote objects having like names.

Embodiment 1

A reactor 1A of Embodiment 1 will be described with reference to FIGS. 1 to 3.

Reactor

Overall Configuration

As shown in FIG. 1 the reactor 1A includes a coil 2 that is formed by winding a wire 2*w* into a helical shape and a magnetic core 3 that is disposed inside and outside the coil 2 and that forms a closed magnetic circuit. The reactor 1A in use is attached to an installation target (not shown) such as a convertor case. For example, before use, the reactor 1A may be attached to a portion that is directly exposed to a liquid coolant 4L (FIG. 7) as described later. A feature of the reactor 1A of Embodiment 1 is that it includes a component (terminal-equipped outer core component 328A) into which a terminal fitting 8A connected to an end portion 2*e* of the wire 2*w* forming the coil 2 and a portion (side main portion 32) of the magnetic core 3 are integrated using a resin (side resin-molded portion 328*m*). Hereinafter, first, overviews of the coil 2 and the magnetic core 3, which are the main constituent members of the reactor 1A, a specific configuration of the terminal-equipped outer core component 328A, which is a characteristic feature, and main effects based on the characteristic feature will be described, and then, details of various configurations and the like of the reactor 1A will be described one by one.

Overview of Coil

Figure 6:
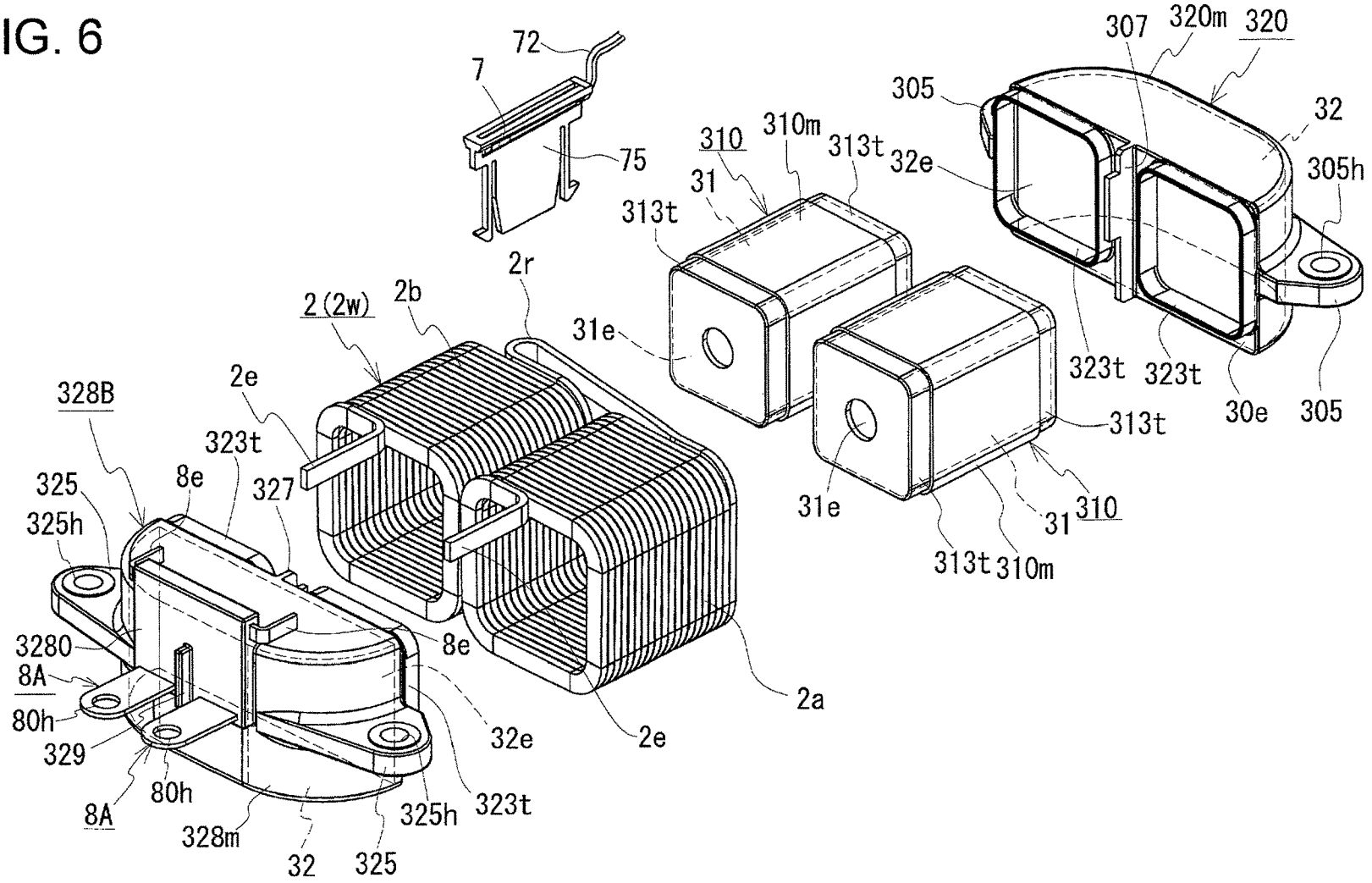
FIG. 6 is an exploded perspective view showing a coil and a magnetic core included in the reactor of Embodiment 2.

The coil 2 shown in this example includes, as shown in FIG. 1, and FIG. 6 and the like, which will be described later, a pair of coil elements 2*a* and 2*b* and a connecting portion 2*r* that connects the two coil elements 2*a* and 2*b* to each other. Each coil element 2*a*, 2*b* is a tube-shaped element (here a rectangular tube-shaped element with rounded corner portions) that is formed by winding the wire 2*w* into a helical shape. The coil elements 2*a* and 2*b* are arranged in parallel (side-by-side) such that their axial directions are parallel to each other. The connecting portion 2*r* is formed by a portion of the wire 2*w*, which forms the coil elements 2*a* and 2*b*, being bent into a U-shape.

A covered wire including a conductor made of a metal, such as copper, a copper alloy, aluminum, or an aluminum alloy, that has excellent conductivity and an insulating covering (not shown) provided on an outer circumference of the conductor and made of an insulating material (typically, polyamideimide) can be preferably used as the wire 2*w*. The conductor may be a rectangular wire, a round wire, or the like. In the wire 2*w* shown in this example, the conductor is a rectangular covered wire, and the coil elements 2*a* and 2*b* are edgewise coils.

Both end portions 2*e* of the wire 2*w* are drawn out from respective turn portions of the coil elements 2*a* and 2*b*. In this example, the two end portions 2*e* are each drawn out from one end surface (surface on the front side of the paper plane in FIG. 1) of the coil elements 2*a* and 2*b* in the axial direction of the coil elements 2*a* and 2*b*, and leading ends of the respective end portions 2*e* reach an outer circumferential edge of the magnetic core 3 (here, the terminal-equipped outer core component 328A) (see also the side view in FIG. 7, which will be described later). The two end portions 2*e* of the wire 2*w* each function as a region to which one end portion 8*e* of a corresponding terminal fitting 8A is joined. At the two end portions 2*e*, the insulating covering has been stripped off, and the conductor (here, the rectangular wire) is exposed. The terminal fittings 8A are connected to these conductor portions. FIG. 1 shows a state in which the two end portions 2*e* of the wire 2*w* are directly joined to the respective end portions 8*e* of the terminal fittings 8A.

Overview of Magnetic Core

Figure 2:
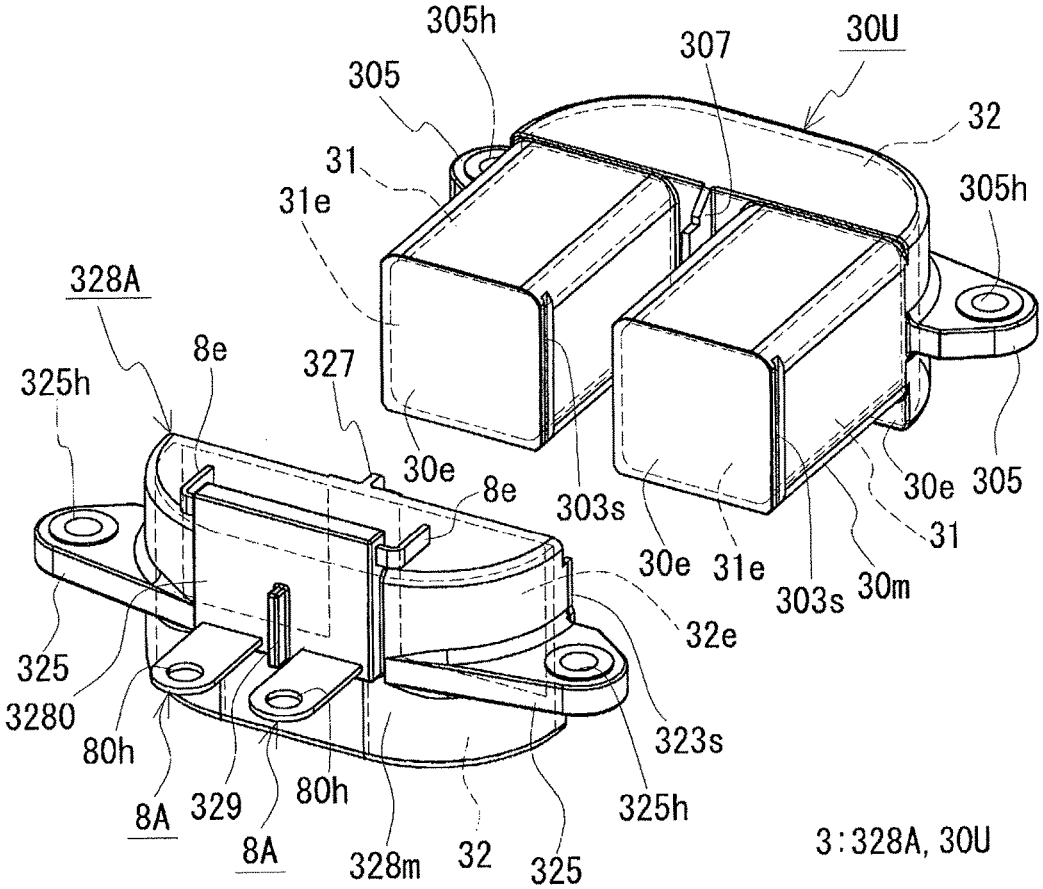
FIG. 2 is an exploded perspective view for explaining a state in which a terminal-equipped outer core component included in the reactor of Embodiment 1 and another core component (U-shaped core component) are assembled.
Figure 3:
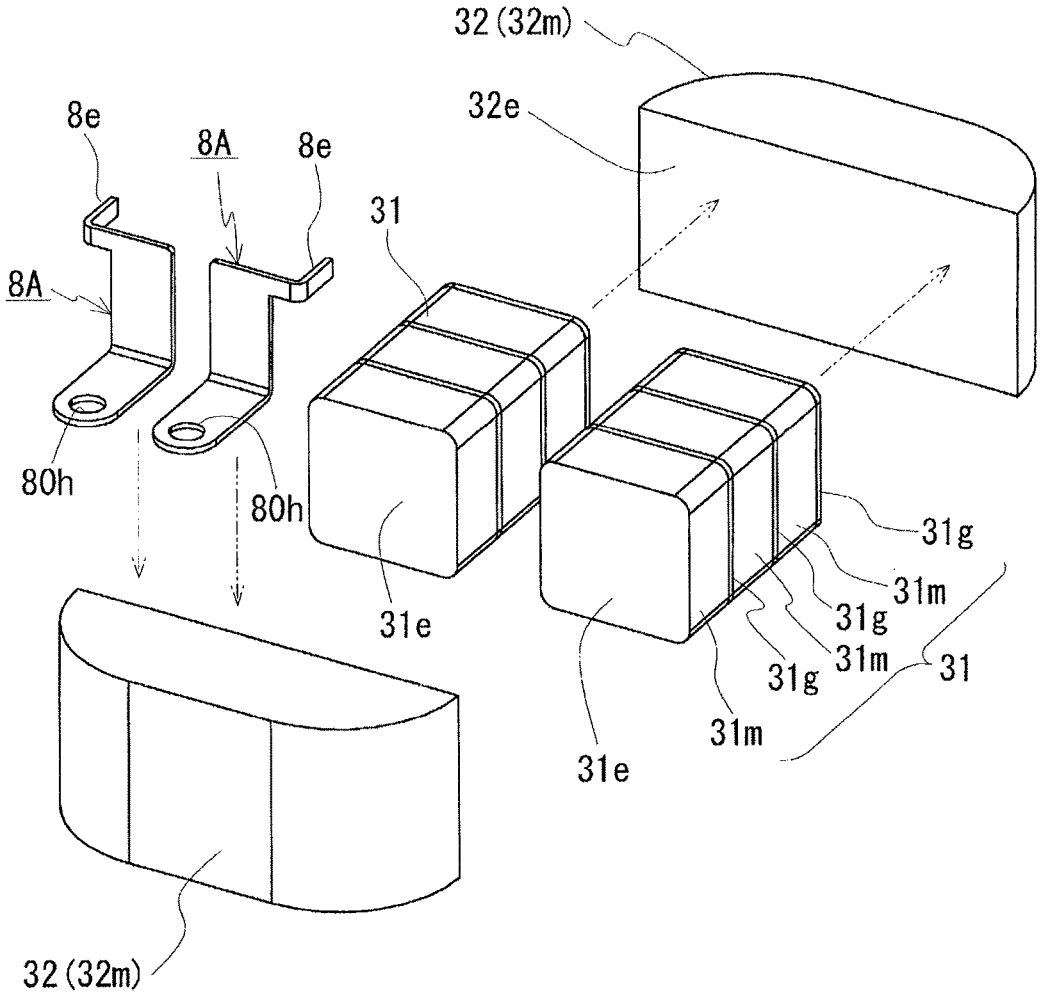
FIG. 3 is an exploded perspective view of a magnetic core included in the reactor of Embodiment 1, the exploded perspective view schematically showing main portions constituting a magnetic circuit and schematically showing terminal fittings.

As shown in FIGS. 2 and 3, the magnetic core 3 shown in this example is constituted mainly by a pair of column-shaped middle main portions 31 and a pair of column-shaped side main portions 32. These main portions 31 and 32 are mainly composed of a soft magnetic material and form a magnetic circuit. The middle main portions 31 are inserted and disposed in the respective coil elements 2*a* and 2*b* (FIG. 1), which are arranged side-by-side, and are used as portions disposed inside the coil 2. The side main portions 32 are portions where the coil 2 is substantially not disposed, the portions protruding from the coil 2. The side main portions 32 are assembled so as to connect the two middle main portions 31, which are arranged side-by-side, and thus, the main portions 31 and 32 are arranged in a ring shape.

The magnetic core 3 shown in this example is constituted by core components obtained by covering those portions (here, middle main portions 31 and side main portions 32) that form the above-described magnetic circuit with resin (here, side resin-molded portion 328*m* and connecting resin-molded portion 30*m*). Here, the magnetic core 3 has a core component that is exposed from one end (left end in FIG. 1) of the coil 2 and a core component that has a portion disposed inside the coil 2. The former core component is the terminal-equipped outer core component 328A that is obtained by covering one of the side main portions 32 with resin as shown in FIG. 2 and that integrally holds the terminal fittings 8A. The latter core component is a U-shaped core component 30U formed of the pair of column-shaped middle main portions 31 and the other side main portion 32 that are integrally molded into a U-shape using resin. Hereinafter, the core components 328A and 30U will be described in detail with reference mainly to FIG. 2.

Terminal-Equipped Outer Core Component

The terminal-equipped outer core component 328A is mainly constituted by one of the side main portions 32, the side resin-molded portion 328*m*, and the terminal fittings 8A. In this example, a column-shaped outer circumferential surface, except for a portion thereof, of the side main portion 32 is covered by the resin composing the side resin-molded portion 328*m*. The terminal fittings 8A are partially embedded in this resin. That is to say, the terminal-equipped outer core component 328A includes an embedding and fixing portion 3280 that is formed of the above-described resin and in which the terminal fittings 8A are partially embedded and held.

The above-described resin is provided along the external shape of the side main portion 32, and the external shape of the terminal-equipped outer core component 328A is generally similar to the external shape of the side main portion 32. It is also possible that those external shapes are dissimilar to each other or are completely different from each other. The shape and constituent material of the side main portion 32, the constituent material of the side resin-molded portion 328*m*, the shape and constituent material of the middle main portion 31, and the constituent material of a middle resin-molded portion will be collectively described later.

Terminal Fittings

The terminal fittings 8A included in the terminal-equipped outer core component 328A are conductive members that electrically connect the coil 2 to an external device (not shown) such as a power supply that powers the coil 2. The terminal fittings 8A are composed of a metal, such as copper, a copper alloy, aluminum, or an aluminum alloy, that has excellent conductivity and typically have a shape having a through hole 80*h* into which a fastening member such as a bolt is inserted. The shape and size of the terminal fittings 8A can be selected as appropriate within such a range that allows the end portions 2*e* of the wire 2, which forms the coil 2, to be connected to respective terminal fittings on the external device side, the external device being provided at a predetermined location, in a state in which the reactor 1A is installed. When the terminal fittings 8A have a plate shape such as that shown in FIG. 3 instead of being the above-described round terminals, the above-described end portions 2*e* of the wire 2 can be easily connected to the terminal fittings on the external device side even in the case where the distance from the end portions 2*e* to those terminal fittings is somewhat large and the end portions 2*e* are away from those terminal fittings in a state in which the reactor 1A is installed.

The terminal fittings 8A shown in this example are each a bent-shaped plate that has been formed by being bent into a predetermined three-dimensional shape. A region (end portion 8*e*) at one end serves as a connection region to be connected to the corresponding end portion 2*e* of the wire 2, which forms the coil 2, and the region at the other side serves as a connection region that has the through hole 80*h* and that is to be connected to the external device. An intermediate region between these two connection regions serves as a held region (embedded region) that is to be held by the side resin-molded portion 328*m*, and the embedding and fixing portion 3280 is provided in this region. The held regions of the respective terminal fittings 8A are indicated by dashed lines in FIG. 1. Here, relative to the intermediate region, the region at one end is bent toward the coil 2 along the axial direction of the coil 2, and the region at the other end is bent toward an outward side of the side main portion 32 along the axial direction of the coil 2, and the intermediate region is disposed parallel to an inner end surface 32*e* (FIG. 2) of the side main portion 32.

Although the connection region (end portion 8*e*) of each terminal fitting 8A shown in this example, the connection region being connected to the corresponding end portion 2*e* of the wire 2, has a flat plate shape, this connection region may also have, for example, a shape, such as a U-shape, in which the end portion 2*e* of the wire 2 can be sandwiched. Moreover, although each terminal fitting 8A in this example has the bent portions, the terminal fitting 8A may also have a flat shape or the like having no bent portion. Similarly to known plate-shaped terminal fittings (e.g., terminal members 9A, 9B of Patent Document 2), the terminal fittings 8A can be manufactured by punching a metal plate into a predetermined shape and size and appropriately forming the resultant metal plate.

Connection of Coil to Terminal Fittings

To connect the end portions 2*e* of the wire 2*w*, which forms the coil 2, to the respective terminal fittings 8A, various type of welding processes such as resistance welding, laser welding, and TIG (Tungsten Inert Gas) welding, soldering, brazing, crimping, vibration welding, and the like can be used. The above-listed methods allow the constituent material of the wire 2*w* and the constituent material of the terminal fittings 8A to be directly joined to each other or to be substantially directly joined to each other with a conductive joining material such as solder. Here, resistance welding is performed. The junction area between the end portions 2*e* of the above-described wire 2*w* and the corresponding terminal fittings 8A can be selected as appropriate. The larger the junction area, the more firmly the end portions 2*e* can be joined to the corresponding terminal fittings 8A. The use of the wire 2*w* whose conductor is a rectangular wire as shown in this example makes it easy to ensure a sufficiently large area to be joined to the plate-shaped terminal fittings 8A and thus makes it easy to establish the above-described directly joined configuration or substantially directly joined configuration. Moreover, the above-described directly joined configuration or the like eliminates the necessity for a fastening member, such as a bolt, and the like to connect the coil 2 to the terminal fittings 8A and thus can reduce the number of components.

In the reactor 1A shown in this example, the end portions 2*e* of the wire 2*w*, which forms the coil 2, may be connected to the corresponding terminal fittings 8A at any time after the coil 2 and the magnetic core 3 have been assembled together. That is to say, as an example of the reactor 1A, a configuration is possible in which the end portions 2*e* of the wire 2*w* are not connected to the terminal fittings 8A. Depending on the shape of the core components 328A and 30U (e.g., Embodiment 2 described later), the end portions 2*e* of the wire 2*w* may be connected to the terminal fittings 8A before the coil 2 and the magnetic core 3 are assembled together. In this case, a reactor in which the end portions 2*e* of the wire 2*w* have been connected to the terminal fittings 8A is obtained.

Although the connecting portions between the end portions 2*e* of the wire 2*w*, which forms the coil 2, and the corresponding terminal fittings 8A may be not covered as shown in FIG. 1, covering the outer circumference of those connecting portions with an insulating material can increase the insulation between components peripheral to the reactor 1A and those connecting portions. For example, when insulating tape is wound around those connecting portions, an insulating layer can be easily formed on the outer circumference of those connecting portions.

U-shaped Core Component

The U-shaped core, component 30U is mainly constituted by the pair of middle main portions 31, the other side main portion 32, and the connecting resin-molded portion 30*m*. The U-shaped core component 30U shown in this example is obtained by joining the inner end surface 32*e* (FIG. 3) of the other side main portion 32 to one end surface 31*e* of each of the pair of middle main portions 31 as indicated by the arrows in FIG. 3 to form a U-shaped intermediate component and then covering substantially the entire circumference of the intermediate component with a resin composing the connecting resin-molded portion 30*m*. The U-shaped core component 30U has a U-shaped external shape as shown in FIG. 2. It is also possible that the external shape of the above-described intermediate component is dissimilar to and even completely different from the external shape of the connecting resin-molded portion 30*m*.

Regions Covered by Side Resin-Molded Portion and Connecting Resin-Molded Portion The region of the terminal-equipped outer core component 328A that is covered by the side resin-molded portion 328*m* and the region of the U-shaped core component 30U that is covered by the connecting resin-molded portion 30*m* can be selected as appropriate. The resin-molded portions 30*m* and 328*m* cover at least a portion of the side main portions 32 and the middle main portions 31. Also, in the terminal-equipped outer core component 328A, the side resin-molded portion 328*m* covers and fixes a portion of the terminal fittings 8A so that the terminal fittings 8A cannot be removed from the side main portion 32. The larger the above-described covered region, the greater the effects that can be achieved by providing the resin-molded portions 30*m* and 328*m*. That is to say, mechanical protection of the side main portions 32 and the middle main portions 31, protection from the environment (e.g., prevention of corrosion due to contact with the liquid coolant 4L and the like), improvement in insulation from the coil 2, improvement in insulation from the terminal fittings 8A, improvement in insulation from a component peripheral to the reactor 1A, firm holding of the terminal fittings 8A, and other effects can be achieved.

In the terminal-equipped outer core component 328A shown in this example, a portion (region to which end surfaces 30*e* of the resin covering the end surfaces 31*e* of the middle main portions 31 are joined) of the inner end surface 32*e* of the side main portion 32 is not covered by the side resin-molded portion 328*m* and is exposed, while the remaining portion is covered by the side resin-molded portion 328*m*. That is to say, in this example, the side main portion 32 is joined to the resin composing the connecting resin-molded portion 30*m*. Joining the core piece to resin, rather than joining resin to resin, makes it easy to reduce an error in the junction portions resulting from a molding tolerance of the resin-molded portion, and thus, the terminal-equipped outer core component 328A and the U-shaped core component 30U can be accurately integrated into one piece. Accordingly, the middle main portions 31 and the side main portions 32 can be accurately integrated into one piece, and a desired inductance can be favorably provided.

In the U-shaped core component 30U shown in this example, another end surface 31*e* of each middle main portion 31 and a portion of an inner end surface 32*e* of the other side main portion 32 are covered by the resin composing the connecting resin-molded portion 30*m*, and thus, end surfaces 30*e* composed of this resin are formed. The above-described resin that covers the other end surfaces 31*e* of the middle main portions 31 is generally a non-magnetic material and therefore functions as a gap material.

In addition, similarly to the U-shaped core component 30U, a configuration of the terminal-equipped outer core component 328A may be adopted in which the entirety of the side main portion 32 is covered by the side resin-molded portion 328*m*. Moreover, a configuration is possible in which a portion of the terminal-equipped outer core component 328A and the U-shaped core component 30U, for example, a portion of an installation surface thereof has no resin-molded portion, and thus the side main portions 32 and the like are exposed.

Thickness of Side Resin-Molded Portion and Connecting Resin-Molded Portion

The thickness of the resin composing the side resin-molded portion 328*m* and the thickness of the resin composing the connecting resin-molded portion 30*m* can both be selected as appropriate. For example, the thickness of the above-described resins may be between 0.1 mm and 3 mm inclusive. Here, the above-described resins that respectively cover the surfaces of the side main portion 32 to be covered and the surfaces of the above-described intermediate component to be covered have a generally uniform thickness. However, in the side resin-molded portion 328*m*, the thickness of the resin at a portion that holds the above-described terminal fittings 8A is thicker than that at the other portions of the side main portion 32, and this thick portion protrudes outward from the side main portion 32. This thick portion constitutes the embedding and fixing portion 3280. Since the thickness of the resin composing the embedding and fixing portion 3280 is locally thick, the insulation of the terminal fittings 8A from a component peripheral to the reactor 1A can be enhanced. Moreover, in this example, the embedding and fixing portion 3280 has a ridge 329 that is interposed between the two terminal fittings 8A. This ridge 329 can enhance the insulation between the terminal fittings 8A.

In addition, the thickness of the above-described resins that respectively cover the surfaces of the side main portion 32 and the surfaces of the above-described intermediate component can be varied from one surface to another. For example, it is possible to set the thickness of the above-described resin that covers the installation surface of the side main portion 32 to be thinner than that for the other surfaces, and to set the thickness of the above-described resin that covers the end surfaces 31*e* of the middle main portions 31 to be thick or thin depending on a desired gap length.

Method for Manufacturing Reactor

The reactor 1A can be manufactured through a process typically including fabrication of an assembled body 10 (FIG. 1) and subsequent connection of the coil 2 to the terminal fittings 8A. Specifically, the coil 2 and the magnetic core 3 (here, the terminal-equipped outer core component 328A and the U-shaped core component 30U) are prepared, and the coil 2 and the magnetic core 3 are assembled together to fabricate the assembled body 10. The core components 328A and 30U have been appropriately fabricated in advance using insert molding or the like as will be described later. In this example, in a state in which the coil 2 is supported by the U-shaped core component 30U, the U-shaped core component 30U and the terminal-equipped outer core component 328A can be connected to each other, and thus assembly can be performed easily. Moreover, in this example, the two core components 328A and 30U have sliding connecting portions 303*s* and 323*s* (described later, FIG. 2), so that it is possible to easily assemble the coil 2 and the magnetic core 3 together while accurately positioning the two core components 328A and 30U.

Main Effects

For the reasons (1) and (2) below, the reactor 1A enables the coil 2 to be accurately connected to the terminal fittings 8A. Moreover, for the reasons (3) and (4) below, the reactor 1A also has excellent assemblability.

(1) Since a portion of the magnetic core 3 and the terminal fittings 8A are integrated into an integrated body (terminal-equipped outer core component 328A), unlike the case where a terminal fitting or a terminal block is a component independent of a portion forming the magnetic circuit, substantially no displacement of the terminal fittings 8A relative to the magnetic core 3 occurs.

(2) Since the above-described integrated body is assembled to the coil 2, when the magnetic core 3 has been positioned relative to the coil 2, the terminal fittings 8A are automatically positioned relative to the coil 2. Consequently, the positioning accuracy of the terminal fittings 8A relative to the coil 2 can be as high as the the positioning accuracy of the magnetic core 3 relative to the coil 2.

(3) Since the above-described integrated body is assembled to the coil 2, the reactor 1A, even though including the terminal fittings 8A, has a small number of components, and is thus assembled through a smaller number of steps than in the case where a terminal fitting or a terminal block is a component independent of the magnetic core and the like.

(4) Since the above-described integrated body is assembled to the coil 2, during assembly of the coil 2 and the magnetic core 3, there is no need to separately perform positioning of the terminal fittings 8A relative to the coil 2, and substantially no time is taken to perform this positioning.

In addition, in the reactor 1A shown in this example, the magnetic core 3 is mainly constituted by two components, namely, the terminal-equipped outer core component 328A and the U-shaped core component 30U, and thus, the magnetic core 3 itself has a small number of assembled components. Moreover, since the sliding connecting portions 303*s* and 323*s* allow the magnetic core 3 to be easily and accurately assembled into a ring shape, the magnetic core 3 can be accurately positioned relative to the coil 2, and hence the terminal fittings 8A can also be accurately positioned relative to the coil 2. Furthermore, the reactor 1A eliminates the necessity for fastening members such as bolts to electrically connect the end portions 2*e* of the wire 2*w*, which forms the coil 2, to the terminal fittings 8A, and thus it is possible to reduce the number of components and to omit a fastening step. From these points as well, the reactor 1A has excellent assemblability.

Details of Configuration etc.

Hereinafter, details of the configurations of the reactor 1A, other available configurations, and the like will be listed and described.

Coil

The coil 2 is typically configured by winding the single, continuous wire 2*w* having no connecting portion into a helical shape. The coil elements 2*a* and 2*b* have the same number of turns, and the two coil elements 2*a* and 2*b* are electrically connected to each other in series. The end surface shape of the coil elements 2*a* and 2*b* may be a rectangular tube shape or the like as described above but can be changed as appropriate to a circular ring shape or the like.

It is possible to fabricate the coil elements using separate wires, and to directly join the other end portions of the wires of the respective coil elements to each other by using the above-described various types of welding processes, soldering, crimping, or the like to form a coil or to join the other end portions of the wires to each other via a separately prepared connecting member (e.g., plate material) to form a coil.

Magnetic Core

The constituent material and manufacturing method of the middle main portions 31 and the side main portions 32, which are the main components of the magnetic core 3, will be described in detail using FIG. 3.

The middle main portions 31 shown in this example are each obtained by combining a plurality of core pieces 31*m* in which a soft magnetic material is used with a plurality of gap materials 31*g* composed of a material having a lower relative magnetic permeability than the core pieces 31*m*. The side main portions 32 shown in this example are core pieces 32*m* in which a soft magnetic material is used. Here, the core pieces 31*m* and 32*m* are powder compacts in which a soft magnetic metal powder is used. For the gap materials 31*g*, a non-magnetic material exemplified by a nonmetallic inorganic material such as alumina and a nonmetallic organic material such as a resin such as unsaturated polyester as well as a low magnetic permeability material produced by combining a soft magnetic material such as an iron powder with a non-magnetic material such as a resin can be used.

With regard to those portions of the magnetic core 3 that form the magnetic circuit, in addition to the configuration in which the gap materials 31*g* are provided, a configuration in which an air gap is provided or a configuration (gapless structure) in which no gaps are provided depending on the relative magnetic permeability of the core pieces 31*m* and 32*m* can be adopted. The number of the core pieces 31*m* and 32*m* and the gap materials 31*g* can be selected as appropriate, and FIG. 3 merely shows an example. Although the gap materials 31*g* can be held integrally with the core pieces 31*m* by the resin composing the connecting resin-molded portion 30*m* (FIG. 2), the core pieces 31*m* can be joined to the gap materials 31*g* using an adhesive, adhesive tape, or the like as appropriate. When the core pieces 31*m* have been joined to the gap materials 31*g* in this manner, the resulting combined bodies of the core pieces 31*m* and the gap materials 31*g* are easy to handle during molding of the resin-molded portion 30*m*, and also a magnetic core 3 capable of maintaining a firmly fixed state can be obtained.

Examples of the soft magnetic material serving as the main ingredient of the core pieces 31*m* and 32*m* include metals such as iron and an iron alloy (Fe—Si alloy, etc.) and nonmetals such as ferrite. A molded component in which a soft magnetic powder made of the above-described soft magnetic material is used or a laminated body in which a plurality of electromagnetic steel sheets having an insulating coating are laminated can be used as the core pieces 31*m* and 32*m*. Examples of the aforementioned molded component include a powder compact (dust core) as well as a sintered body, a composite material containing a soft magnetic powder and a resin, and the like.

A powder compact is typically obtained by molding a raw material powder containing the above-described soft magnetic material, and a binder (resin, etc.) and a lubricant, if necessary, and then performing heat treatment for the purpose of removing distortion that occurs during the molding process and other purposes. Due to this heat treatment, the binder and the lubricant typically disappear, and thus, a powder compact having a higher saturation magnetic flux density and relative magnetic permeability than those of a composite material is likely to be obtained.

A composite material can be easily molded, even when a complex three-dimensional shape is to be molded, by using injection molding. A thermosetting resin such as an epoxy resin or a thermoplastic resin such as a polyphenylene sulfide (PPS) resin can be used as the resin serving as a binder in the composite material. The content of the soft magnetic powder in the composite material may be between 20 vol % and 75 vol % inclusive and more particularly between 30 vol % and 65 vol % inclusive, with respect to 100 vol % of the composite material. The balance mainly includes a nonmetallic organic material such as the above-described resin. In addition to the above-described resin, the balance may further include, for example, a nonmetallic inorganic material, such as alumina or a ceramic such as silica (for example, in an amount between 0.2 vol % and 20 vol % inclusive with respect to 100 vol % of the composite material). The magnetic characteristics of the composite material can be easily adjusted by adjusting the amounts of the soft magnetic powder, the resin, the nonmetallic inorganic material, and the like that are blended in the composite material. A composite material having a low relative magnetic permeability is likely to be obtained when a non-magnetic material such as a resin is contained therein. In the case where a resin-molded portion such as the connecting resin-molded portion 30*m* is molded on the surfaces of the middle main portions 31 and the surfaces of the side main portions 32, the middle main portions 31 and the side main portions 32 including the core pieces composed of a composite material, a resin that is less likely to be deteriorated by heat, pressure, and the like during molding of the resin-molded portion can be appropriately selected as the resin in the composite material.

With regard to those portions of the magnetic core 3 that form the magnetic circuit, in addition to the configuration in which those portions are composed of the same material except for the gap materials, a configuration is possible in which those portions are made to have different magnetic characteristics by appropriately changing the constituent material, the manufacturing method, and the like of the core pieces. For example, a configuration may be adopted in which the middle main portions 31 and the side main portions 32 have different magnetic characteristics.

In this example, the middle main portions 31 have a rectangular parallelepiped shape and the side main portions 32 are each an irregular column-shaped body whose end surfaces (upper and lower surfaces in FIG. 3) are dome-shaped; however, these shapes can be changed as appropriate. For example, it is possible that the middle main portions 31 have a cylindrical shape and the side main portions 32 have a rectangular parallelepiped shape. In addition, those portions that form the magnetic circuit can constitute, for example, a U-shaped body obtained by integrally molding the pair of middle main portions 31 and one of the side main portions 32 or an L-shaped body obtained by integrally molding one of the middle main portions 31 and one of the side main portions 32.

In a state in which the reactor 1A shown in this example is installed, regions (regions on the lower side in FIG. 3) of the respective side main portions 32 on a side to be mounted to an installation target protrude from the middle main portions 31. More specifically, the size of the side main portions 32 is adjusted so that installation surfaces (lower surfaces in FIG. 3) of the two side main portions 32 are approximately flush with an installation surface (lower surface in FIG. 1) of the coil 2. The installation surfaces of the two side main portions 32 are covered by the resins composing the side resin-molded portion 328*m* and the connecting resin-molded portion 30*m* (FIG. 2), respectively, and the terminal-equipped outer core component 328A and the U-shaped core component 30U have flat installation surfaces formed of the above-described resins. The thickness of the above-described resins covering the installation surfaces is as thin as less than 2 mm, and the two side main portions 32 protrude sufficiently from the the middle main portions 31 (FIG. 2). An installation surface of the reactor 1A is composed of the resins covering the installation surface of the coil 2 and the installation surfaces of the side main portions 32, and is here a substantially flat surface. Therefore, not only the coil 2 but also the magnetic core 3 (especially the side main portions 32) of the reactor 1A are surface-supported on the installation target.

Meanwhile, the size of the side main portions 32 is adjusted so that surfaces (upper surfaces in FIG. 3) of the two side main portions 32 that are opposite from the installation surfaces are substantially flush with the middle main portions 31. Thus, the end portions 2*e* and the connecting portion 2*r* of the wire 2*w*, which forms the coil 2, can be easily disposed above the side main portions 32 without being obstructed by the side main portions 32 (FIG. 1).

Constituent Material of Side Resin-Molded Portion and Connecting Resin-Molded Portion An appropriate resin can be used as the constituent material of the side resin-molded portion 328*m* and the connecting resin-molded portion 30*m*. In particular, since the magnetic core 3 is disposed in the vicinity of the coil 2, the above-described constituent material is preferably an insulating resin. Specific examples of the resin include thermoplastic resins such as a PPS resin, a polytetrafluoroethylene (PTFE) resin, a liquid crystal polymer (LCP), nylon 6, nylon 66, and a polybutylene terephthalate (PBT) resin. The above-described resin can contain a filler made of a ceramic such as silicon nitride ($Si_3N_4$), alumina ($Al_2O_3$), aluminum nitride (AlN), boron nitride (BN), silicon carbide (SiC), or mullite. The use of a resin containing one or more types of fillers made of the above-listed ceramics can enhance the heat dissipation properties and the insulation properties of the side resin-molded portion 328*m* and the connecting resin-molded portion 30*m*. Depending on the composition of the filler, the effects of suppressing vibration and noise can also be expected.

Elements Integrally Molded with Side Resin-Molded Portion and Connecting Resin-Molded Portion Sliding Connecting Portion In addition, the terminal-equipped outer core component 328A and the U-shaped core component 30U shown in this example include the mutually engageable sliding connecting portions 323*s* and 303*s* (FIG. 2), respectively. The sliding connecting portions 323*s* and 303*s* enable the terminal-equipped outer core component 328A and the U-shaped core component 30U to be mechanically connected to each other by those core components being slid in a direction (up-down direction in FIG. 2) that is orthogonal to both of the axial direction of the coil 2 and a direction (left-right direction in FIGS. 1 and 2) in which the coil elements 2*a* and 2*b* are arranged side-by-side. In this example, the sliding connecting portions 323*s* provided in the terminal-equipped outer core component 328A are ridges extending in the up-down direction, and the sliding connecting portions 303*s* provided in the U-shaped core component 30U are grooves which extend in the up-down direction and into which the ridges are to be fitted; however, it is also possible that the sliding connecting portions 323*s* are grooves and the sliding connecting portions 303*s* are ridges. Moreover, in this example, an abutment protrusion (not shown) is provided on an end surface of the terminal-equipped outer core component 328A, the abutment protrusion serving to position the U-shaped core component 30U when the sliding connecting portions 303*s* (grooves) of the U-shaped core component 30U are applied to and moved along the corresponding sliding connecting portions 323*s* (ridges) of the terminal-equipped outer core component 328A from the upper side in FIG. 2. The abutment protrusion is a ridge protruding from the end surface of the terminal-equipped outer core component 328A toward the middle main portions 31, and is provided so as to abut against a lower edge of the U-shaped core component 30U when the two core components 328A and 30U are connected to each other. The two core components 328A and 30U can be easily assembled into a ring shape by the U-shaped core component 30U being slid relative to the terminal-equipped outer core component 328A until abutting against this abutment protrusion. Moreover, when connected together in this manner, the two core components 328A and 30U can be maintained in the state in which these core components are assembled in the ring shape.

Although the mechanical engagement using the sliding connecting portions 323*s* and 303*s* will suffice, if the two core components 328A and 30U are further joined to each other by appropriately using an adhesive or the like, the core components can be more firmly integrated into one piece. In this example, a sheet-shaped adhesive may be disposed, or an adhesive layer may be formed by applying or spraying an adhesive, on the inner end surface 32*e* of the side main portion 32 of the terminal-equipped outer core component 328A, the end surfaces 30*e* of the U-shaped core component 30U, or the like before engagement, or alternatively, a liquid adhesive may be filled between the end surface (inner end surface 32*e* of the side main portion 32) of the terminal-equipped outer core component 328A and the end surfaces 30*e* of the U-shaped core component 30U after engagement, and afterward, solidification (hardening) can be performed as appropriate. An adhesive containing as a main ingredient a resin such as (1) a thermosetting resin such as an epoxy resin, a silicone resin, or an unsaturated polyester, (2) a thermoplastic resin such as a PPS resin or LCP, (3) an ultraviolet (light) cure resin such as urethane acrylate, acrylic resin acrylate, or epoxy acrylate, especially an adhesive containing an insulating resin as the main ingredient can be preferably used the adhesive. The ultraviolet cure resin does not require heating to cure, and thus, the coil 2 and the magnetic core 3 (especially the side resin-molded portion 328*m* and the connecting resin-molded portion 30*m*) can be prevented from being exposed to heat during curing of the adhesive. Therefore, thermal damage to the coil 2 and the magnetic core 3 (especially the resin-molded portions 328*m* and 30*m*) can be suppressed. It is also possible that the coil 2 and the magnetic core 3 are joined to each other using an adhesive.

Attachment Portion

Figure 7:
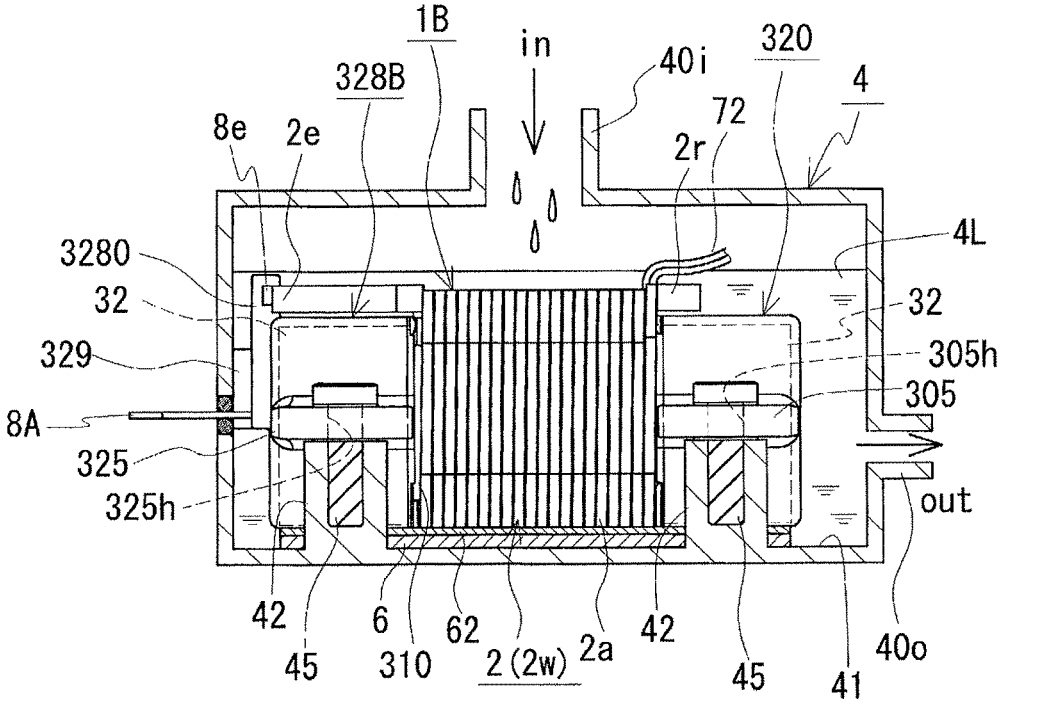
FIG. 7 is a schematic explanatory diagram illustrating an example of a state in which the reactor of Embodiment 2 is used.

In addition, the terminal-equipped outer core component 328A and the U-shaped core component 30U shown in this example include attachment portions 325 and 305 (FIG. 2), respectively, to be attached to the installation target (see also the side view in FIG. 7). Here, the attachment portions 325 and 305 are protruding pieces protruding outward from the terminal-equipped outer core component 328A and from the side main portion 32 of the U-shaped core component 30U, respectively, and have bolt holes 325*h* and 305*h*, respectively, into each of which a bolt 45 (FIG. 7) is to be inserted. The number (here, a total of 4) of the attachment portions 325 and 305 and the positions at which those attachment portions are formed can be selected as appropriate. Here, the attachment portions 325 and 305 are provided at a middle portion of the respective side main portions 32 with respect to the up-down direction; however, the attachment portions 325 and 305 can be provided on the lower side so as to be flush with the installation surfaces of the terminal-equipped outer core component 328A and the U-shaped core component 30U. Here, the bolt holes 325*h* and 305*h* are each formed using a metal tube. The metal tube has a higher strength than the resin composing the side resin-molded portion 328*m* and the connecting resin-molded portion 30*m*, and thus can sufficiently withstand the fastening force from the corresponding bolt 45.

Partitioning Portion

In addition, the terminal-equipped outer core component 328A and the U-shaped core component 30U shown in this example include partitioning portions 327 and 307 (FIG. 2), respectively, that protrude from the end surfaces 30*e* composed of the resin covering the inner end surfaces 32*e* of the side main portions 32 and that are interposed between the coil elements 2*a* and 2*b* (FIG. 1) when the coil 2 (FIG. 1) has been assembled. The partitioning portions 327 and 307 can enhance the insulation between the coil elements 2*a* and 2*b*.

At least one of the sliding connecting portions 323*s* and 303*s*, the attachment portions 325 and 305, and the partitioning portion 327 and 307 that have been described above can be omitted. The side resin-molded portion 328*m* and the connecting resin-molded portion 30*m*, even though having a complicated external shape into which the above-described various elements including the terminal fittings 8A are integrally molded, can be easily molded by using injection molding such as insert molding. To mold the side resin-molded portion 328*m*, insert molding or the like can be performed by using the side main portion 32 as a core and placing also the terminal fittings 8A in a mold such that the terminal fittings 8A having a predetermined shape are fixed at predetermined positions on this side main portion 32. The connecting resin-molded portion 30*m* can be molded by performing insert molding or the like by using, as a core, an intermediate component obtained by assembling the other side main portion 32 and the pair of middle main portions 31 into a U-shape as shown in FIG. 3.

Sensor

In addition, a configuration is also possible in which the reactor 1A includes a sensor 7 (see FIG. 5, which will be described later) for measuring a physical quantity during operation. Details of the sensor 7 will be described in Embodiment 2.

Embodiment 2

Figure 4:
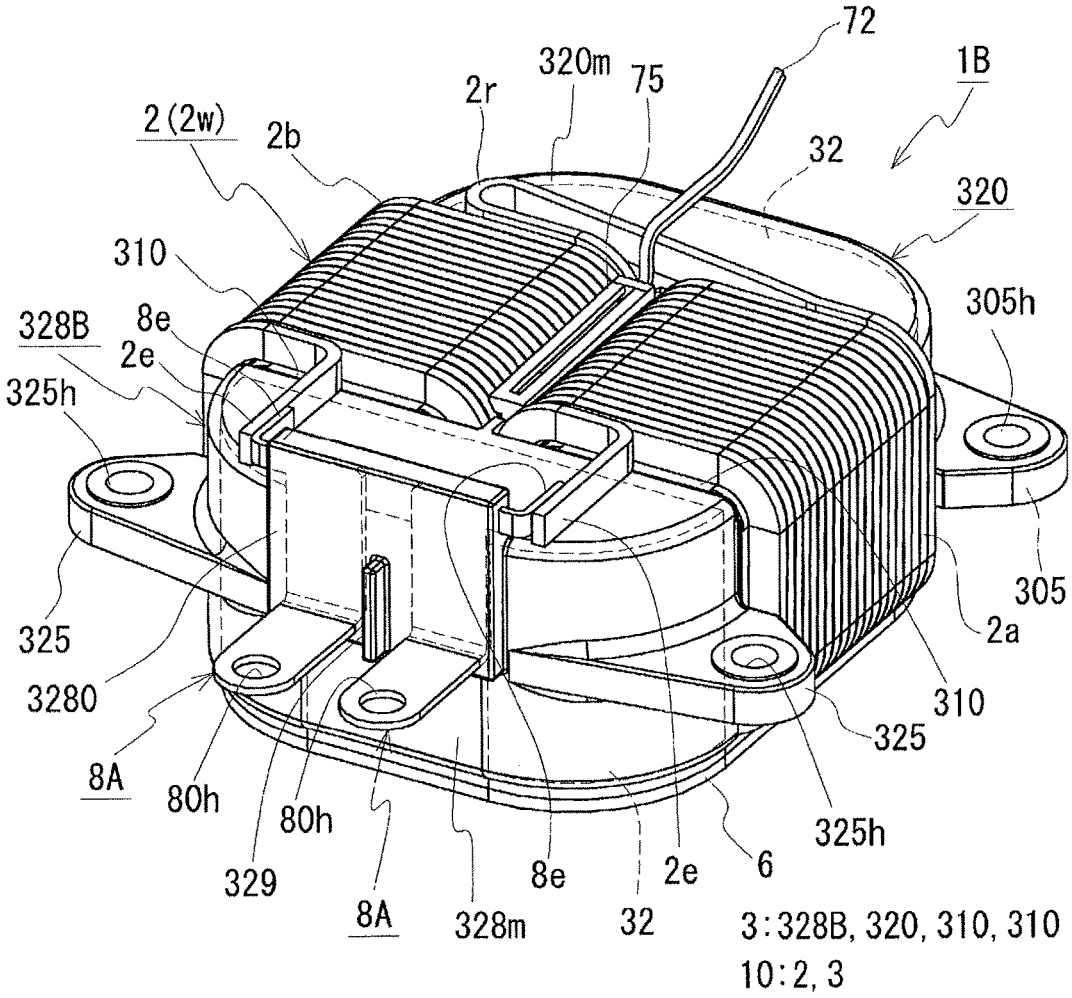
FIG. 4 is a schematic perspective view showing a reactor of Embodiment 2.
Figure 5:
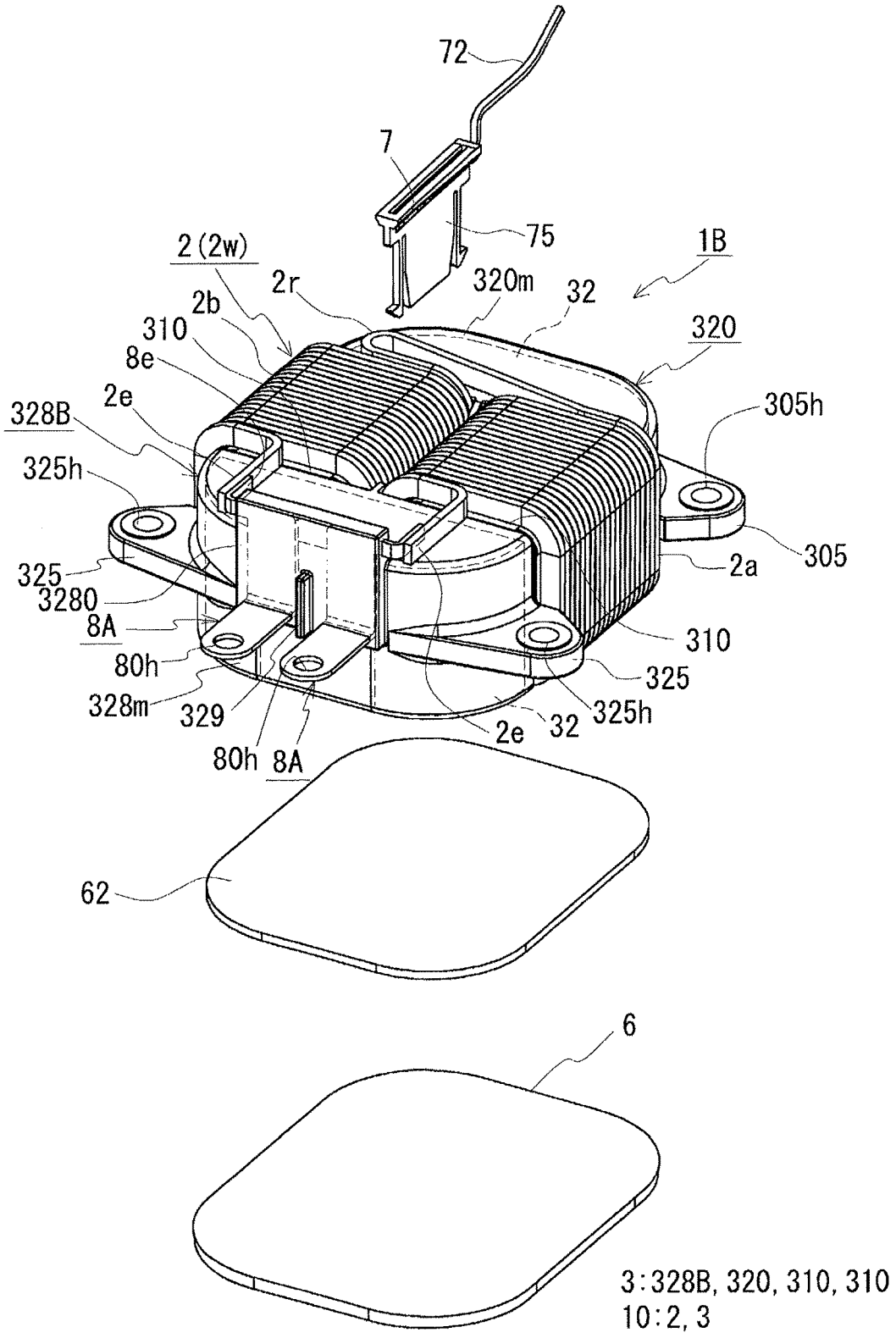
FIG. 5 is an exploded perspective view showing the reactor of Embodiment 2.

A reactor 1B of Embodiment 2 and a usage example thereof will be described with reference to FIGS. 4 to 7. When compared with the reactor 1A of Embodiment 1 above, the reactor 1B of Embodiment 2 further includes a junction layer 62 (FIGS. 5 and 7) and a heat dissipation plate 6 (FIGS. 4, 5, and 7). In particular, the assembled body 10 of the coil 2 and the magnetic core 3 and the heat dissipation plate 6 are fixed to each other by the junction layer 62 (FIG. 7), thereby constituting an integrated body (FIG. 4). Moreover, in the reactor 1B of Embodiment 2, the magnetic core 3 includes a pair of inner core components 310 (FIG. 6) obtained by the middle main portions 31 (FIG. 6) being respectively covered with middle resin-molded portions 310*m* (FIG. 6) and a pair of outer core components 328B and 320 (FIGS. 4 to 6) obtained by the side main portions 32 (FIGS. 4 to 6) being respectively covered with side resin-molded portions 328*m* and 320*m* (FIGS. 4 to 6). That is to say, in the reactor 1B, the magnetic core 3 includes the four core components 328B, 320, 310, and 310 in total. Furthermore, the reactor 1B also includes a sensor 7 (FIG. 6). Hereinafter, the core components and the effects of this configuration as well as the junction layer 62, the heat dissipation plate 6, and the sensor 7 and the effects that are achieved by having these components will be described one by one.

Core Components

In the outer core component 320 shown in this example, similarly to the terminal-equipped outer core component 328B, a portion of the inner end surface 32*e* of the other side main portion 32 is exposed from the side resin-molded portion 320*m* (FIG. 6), and the other portions are covered by the resin composing the side resin-molded portion 320*m* and having a generally uniform thickness. With regard to the inner core components 310, substantially the entirety of an outer circumferential surface of each middle main portions 31 is covered by the resin composing the corresponding middle resin-molded portion 310*m*. In this example, a portion of each end surface 31*e* of the middle main portion 31 is exposed from the middle resin-molded portion 310*m*. The exposed portions (here having a circular shape) are formed by a support member having supported the middle main portion 31 during molding of the resin-molded portion. The exposed portions are closed by the outer core components 328B and 320, respectively, but can each be used as a space into which an adhesive for joining the main portions 31 and 32 to each other is filled.

The outer core components 328B and 320 and the inner core components 310 shown in this example do not have the sliding connecting portions described in Embodiment 1, but do have engagement portions that engage with one another and thus perform positioning. The terminal-equipped outer core component 328B (outer core component 320) is provided with short tube-shaped portions 323*t* that are made of the resin composing the side resin-molded portion 328*m* (320*m*) and that individually protrude from the end surface 30*e* covering the inner end surface 32*e* of the side main portion 32 toward the coil elements 2*a* and 2*b*. The inner core components 310 are each provided with, at both end portions, thin portions 313*t* to which the corresponding tube-shaped portions 323*t* are fitted. Here, in each of the inner core components 310, the thickness of the resin covering the outer circumferential surface of the middle main portion 31 is made thinner at the both end portions than at a middle portion to provide the thin portions 313*t*. The thickness of the tube-shaped portions 323*t* and the thickness of the thin portions 313*t* are adjusted so that when the tube-shaped portions 323*t* have been fitted to the thin portions 313*t*, the surface of the tube-shaped portions 323*t* is substantially flush with the surface of the aforementioned middle portion. The above-described engagement portions are formed by the tube-shaped portions 323*t* and the thin portions 313*t*.

The reactor 1B of Embodiment 2, although including the four core components 328B, 320, 310, and 310 as described above, has the engagement portions (tube-shaped portions 323*t* and thin portions 313*t*), and thus enables the core components to be easily positioned relative to one another and to be accurately assembled together. Moreover, the two inner core components 310 are first assembled to the outer core component 320 to form a U-shaped body, and thus, as in the case of the U-shaped core component 30U of Embodiment 1, the coil 2 can be supported by the two inner core components 310, and assembly to the terminal-equipped outer core component 328B can be easily performed. Thus, similarly to Embodiment 1, the reactor 1B enables connection of the coil 2 to the terminal fittings 8A with excellent accuracy and has excellent assemblability. Moreover, all of the core components 328B, 320, 310, and 310 shown in this example have a simple shape conforming to the side main portions 32 and the middle main portions 31, and thus are easy to mold and have excellent ease of manufacture. Therefore, the reactor 1B also has excellent productivity. Furthermore, since the reactor 1B includes the middle resin-molded portions 310*m* in addition to the side resin-molded portion 320*m*, the reactor 1B can also achieve, similarly to Embodiment 1, mechanical protection of the main portions 31 and 32, protection from the environment, and improvement in insulation from the coil 2 and peripheral components.

Junction Layer

As an example of the reactor, a configuration is possible in which a junction layer is provided on at least the installation surface of the coil 2 of the installation surface of the reactor. As shown in this example, it is preferable if the junction layer 62 is provided over substantially the entire installation surface of the reactor 1B (FIG. 5) because stable fixation to the heat dissipation plate 6, an improvement in the heat dissipation properties due to an increase in the area of contact with the heat dissipation plate 6, and the like can be expected. With regard to the constituent material of the junction layer 62, typically, a resin (adhesive) having such a degree of heat resistance that does not allow the resin to soften at the highest temperature that can be reached during use of the reactor 1B is preferable, and furthermore, an insulating resin is preferable in order to enhance insulation between the reactor 1B and the installation target. Specific examples of the resins include thermosetting resins such as an epoxy resin, a silicone resin, and unsaturated polyester and thermoplastic insulating resins such as a PPS resin and LCP. If the insulating resin contains a filler made of the above-described ceramic, the heat dissipation properties, the insulation properties, and the like can be improved. A junction layer 62 having a thermal conductivity of 0.1 W/m·K or more, particularly 1 W/m·K or more, and more particularly 2 W/m·K or more has excellent thermal conduction properties and is preferable. The junction layer 62 can be formed by using a sheet-like material, for example, or by performing application or spraying.

Since the coil 2 can be fixed to the heat dissipation plate 6 by the junction layer 62, even when the coil 2 is subjected to vibration and the like during use of the reactor 1B, behaviors such as elongation/contraction of the coil 2 or rubbing of the turns of the coil 2 against each other can be prevented. In particular, in this example, the junction layer 62 is provided over the entire length of the coil elements 2*a* and 2*b* (FIG. 5), and thus the above-described behaviors of the coil 2 can be prevented more reliably. Furthermore, in the reactor 1B shown in this example, the coil elements 2*a* and 2*b* are edgewise coils and thus have a high space factor and a small size, and also the coil elements 2*a* and 2*b* have a rectangular tube shape and thus make it easy for the installation surface of the coil 2 to have a planar shape and make it easy to ensure a large area of contact between the coil 2 and the heat dissipation plate 6. From this point, the coil 2 and the heat dissipation plate 6 can be sufficiently fixed to each other by the junction layer 62. The thickness (before installation) of the junction layer 62 may be less than 2 mm, particularly 1 mm or less, and more particularly 0.5 mm or less. There are cases where the thickness of the junction layer 62 decreases (for example, decreases to about 0.1 mm) after the installation of the reactor 1B.

Heat Dissipation Plate

As an example of the reactor, a configuration is possible in which the reactor includes a heat dissipation plate that is disposed at any desired position of the coil 2, which generates heat during use. The reactor 1B shown in this example includes the heat dissipation plate 6 disposed on the installation surface of the coil 2.

Examples of the constituent material of the heat dissipation plate 6 include metals and nonmetallic materials such as the above-described ceramics. Specific examples of the metals include aluminum, an aluminum alloy, magnesium, a magnesium alloy, copper, a copper alloy, silver, a silver alloy, iron, an austenitic stainless steel, and the like. Metals have excellent thermal conduction properties, and especially aluminum and its alloys are lightweight and also have excellent processability. The thickness of the heat dissipation plate 6 can be selected as appropriate, and may be approximately between 2 mm and 5 mm inclusive, for example.

It is sufficient if the heat dissipation plate 6 has a size corresponding to the installation surface of the coil 2, and the size and shape of the heat dissipation plate 6 can be selected as appropriate. The heat dissipation plate 6 shown in this example has a size that corresponds to not only the installation surface of the coil 2 but also the installation surface of the assembled body 10 of the coil 2 and the magnetic core 3. Therefore, the reactor 1B can favorably transfer not only in addition to the heat of the coil 2 but also the heat of the magnetic core 3. Moreover, if the heat dissipation plate 6 is sufficiently larger than the installation surface of the assembled body 10, for example, the heat dissipation plate 6 can function as a support member that integrally supports the assembled body 10, and thus, it is expected that transport and the like is easy. Although the heat dissipation plate 6 shown in this example has a rectangular shape, for example, a configuration in which the heat dissipation plate 6 has at its four corners through holes (not shown) into which respective bosses 42 (FIG. 7) can be inserted or other configurations may also be adopted.

Sensor

The sensor 7 may be, for example, a temperature sensor, a current sensor, a voltage sensor, a magnetic flux sensor, an acceleration sensor, or the like. The sensor 7 shown in this example is a temperature sensor including a thermosensitive element such as a thermistor, and is configured as an integrated member including a protective portion (e.g., tube made of resin or the like) that protects the thermosensitive element and wiring 72 that transmits information from the thermosensitive element to the outside (FIGS. 5 and 6). Here, the position at which the sensor 7 is arranged is set between the two coil elements 2*a* and 2*b*, and the reactor 1B includes a sensor retaining member 75 that retains the integrated member at the above-described predetermined arrangement position. The sensor retaining member 75 has claw portions engageable with the partitioning portions 307 and 327 (FIG. 6). When the sensor retaining member 75 has been inserted between the coil elements 2*a* and 2*b* and the aforementioned claw portions have been engaged with the partitioning portions 307 and 327, respectively, the above-described integrated member is substantially prevented from being displaced from the arrangement position, and can be favorably maintained at the predetermined arrangement position. Moreover, a configuration is adopted in which a portion of the sensor 7 is covered by the sensor retaining member 75. Thus, the sensor 7 is unlikely to come into contact with the liquid coolant 4L, for example, and the physical quantity of the reactor 1B is likely to be properly measured. It is possible to adopt a configuration in which the sensor 7 is further fixed to a predetermined arrangement position of the sensor retaining member 75 using an adhesive such as an epoxy adhesive or an acrylic adhesive, or a configuration in which the sensor 7 is fixed to a predetermined arrangement position using only the above-described adhesive without using the sensor retaining member 75. Similarly to the side resin-molded portion 328*m* and the like, the sensor retaining member 75 is composed of an insulating resin, and thus can enhance the insulation between the coil elements 2*a* and 2*b* like the partitioning portions 307 and 327.

Effects of this Configuration

When the reactor 1B of the Embodiment 2 is attached to the installation target, the heat dissipation plate 6 can be interposed between the installation surface of the coil 2 and the installation target. In addition to the above-described effects that are achieved by the reactor 1A of Embodiment 1, the reactor 1B also achieves excellent heat dissipation properties by the interposed heat dissipation plate 6 being used as a heat dissipation path for the coil 2. In particular, in the reactor 1B, the assembled body 10 (especially, the coil 2) and the heat dissipation plate 6 are firmly fixed to each other by the junction layer 62, so that not only the heat of the coil 2 but also the heat of the magnetic core 3 is efficiently and uniformly transferred to the installation target of the reactor 1B. Accordingly, the reactor 1B has superior heat dissipation properties. The heat dissipation plate 6 can be used as the support member for the assembled body 10, and it is expected that the reactor 1B including the heat dissipation plate 6 can enhance the strength and rigidity of the assembled body 10 as an integrated body. Furthermore, with the reactor 1B, the temperature and the like of the reactor 1B (especially, the coil 2) can be properly measured by the sensor 7, and thus high heat dissipation properties can be maintained by properly controlling the cooling state.

Usage Example

An example of a state in which the reactor 1B of Embodiment 2 is used will be described with reference to FIG. 7. FIG. 7 shows a cooling case 4 in cross section so as to facilitate understanding, and shows a side surface of the reactor 1B in a simplified manner. The reactor 1B is used in a state in which, for example, the assembled body 10 of the coil 2 and the magnetic core 3 are housed in the cooling case 4 and fixed inside the case 4. The case 4 is a container into and from which the liquid coolant 4L is supplied and discharged, and includes an inlet port 40*i* through which the liquid coolant 4L is supplied into the case 4, an outlet port 40*o* through which the liquid coolant 4L in the case 4 is discharged to the outside of the case 4, a space in which the assembled body 10 is housed and the liquid coolant 4L can be accumulated, and a fixing portion (here the bosses 42 having respective bolt holes in which the bolts 45 are attached) that fixes the assembled body 10. The liquid coolant 4L is cooled to an appropriate predetermined temperature by an external cooler (not shown) and supplied into the case 4 through the inlet port 40*i* using a supply mechanism (not shown) such as a pump. The liquid coolant 4L introduced into the case 4 comes into contact with the assembled body 10, thereby cooling the reactor 1B. The liquid coolant 4L whose temperature has been increased by the contact with the assembled body 10 is discharged to the outside of the case 4 through the outlet port 40*o* and returned to the above-described cooler or the like. When an appropriate supply mechanism is used as described above, the liquid coolant 4L can be supplied into the case 4 in a circulating manner. This case 4 may be integrally formed with a converter case, for example.

In the example shown in FIG. 7, the cooling case 4 is a container having a rectangular cross section and has, on its attachment surface (inner bottom surface) 41 constituted by a flat surface, a region on which the assembled body 10 is mounted and a plurality of bosses 42 (here, four bosses) on which the attachment portions 305 and 325 of the assembled body 10 are placed. The assembled body 10 can be fixed inside the case 4 by screwing the bolts 45 such that the individual bolts 45 are inserted into the bolt holes 305*h* and 325*h* (FIGS. 4 to 6) of the attachment portions 305 and 325 and the bolt holes of the bosses 42. There are cases where the case 4 does not have the bosses 42. With the bosses 42, a sufficient fastening length of the bolts 45 can be ensured without making the case 4 have a large thickness over the entire bottom surface, and thus, the assembled body 10 can be firmly fixed.

The reactor 1B shown in this example has the junction layer 62 and the heat dissipation plate 6, which are interposed between the attachment surface 41 of the cooling case 4 and the installation surface (here, the lower surface of the coil 2 and the lower surfaces of the outer core components 328B and 320) of the assembled body 10 of the coil 2 and the magnetic core 3. The above-described installation surface is constituted by a substantially flat surface as in the case of the reactor 1A of Embodiment 1, and an outer surface of the heat dissipation plate 6 covering this installation surface is substantially parallel to the installation surface (flat surface). Therefore, the assembled body 10 of the reactor 1B can come into surface contact with the attachment surface 41 of the case 4 and is thus stably fixed to the case 4. If the case 4 is made of a metal, the heat of the assembled body 10 is favorably transferred from the heat dissipation plate 6 to the case 4 with which the heat dissipation plate 6 is in surface contact, and thus excellent heat dissipation properties are achieved. It should be noted that although FIG. 7 shows a thick junction layer 62 in an exaggerating manner so as to facilitate understanding, practically, the junction layer 62 can be thin.

The size of openings of the inlet port 40*i* and the outlet port 40*o* and the positions at which these holes are formed can be selected as appropriate. For example, a state in which the assembled body 10 is immersed in the liquid coolant 4L (FIG. 7) or a state in which the assembled body 10 is allowed to come into contact with the liquid coolant 4L that is successively supplied can be created by adjusting the above-described size and positions and adjusting the transport conditions of the liquid coolant 4L. Here, in a state in which the assembled body 10 has been housed and fixed in the cooling case 4, the inlet port 40*i* is provided in an upper portion (on a side away from the assembled body 10) of the case 4, and the outlet port 40*o* is provided near the attachment surface 41 of the case 4 (near a region where the assembled body 10 is fixed). Moreover, the opening diameter $\varphi_o$ of the outlet port 40*o* is set to be smaller than the opening diameter $\varphi_i$ of the inlet port 40*i* so that substantially the entirety of the assembled body 10 excluding the contact region with the attachment surface 41 of the case 4 is always immersed in the liquid coolant 4L.

Examples of the constituent material of the cooling case 4 include metals such as aluminum and an aluminum alloy. Metals generally have a high thermal conductivity and excellent heat dissipation properties. Depending on the composition, metals may have advantages including excellent corrosion resistance and chemical resistance against the liquid coolant 4L, excellent heat resistance, and excellent mechanical strength. On the other hand, examples of the constituent material of the case 4 may also include a nonmetallic material such as a thermosetting resin or a thermoplastic resin. Resins are lightweight, and furthermore, depending on the composition, resins have advantages including excellent corrosion resistance and chemical resistance against the liquid coolant 4L.

With regard to the liquid coolant 4L, a liquid coolant that does not change its form (does not vaporize) at the highest temperature that can be reached during use of the reactor 1B has a high cooling ability and thus can be preferably used. Specifically, ATF (Automatic Transmission Fluid), which is a lubricant for an automatic transmission, a fluorine-based inert liquid such as Fluorinert (registered trademark), a chlorofluorocarbon coolant such as HCFC-123 or HFC-134a, an alcoholic coolant such as methanol or alcohol, or a ketone-based coolant such as acetone can be used. In the case where the reactor 1B is applied to an in-vehicle component for use in a vehicle such as an automobile, making use of the ATF eliminates the necessity for separately preparing the liquid coolant 4L, thereby making it possible for a heat dissipation structure of the reactor 1B by the liquid coolant 4L to be formed in a straightforward manner by using a circulating supply mechanism for the ATF.

In the case where the reactor 1B is installed in an environment in which the liquid coolant 4L described above is supplied, substantially the entirety of the reactor 1B can come into contact with the liquid coolant 4L. In particular, the coil 2, which generates heat during use of the reactor 1B, can directly come into contact with the liquid coolant 4L. Thus, heat can be effectively dissipated using the high cooling ability of the liquid coolant 4L, and so the heat dissipation properties is excellent. It should be noted that this usage example can also be applied to other embodiments including Embodiment 1.

Embodiment 3

A reactor 1C of Embodiment 3 will be described with reference to FIGS. 8 to 10. Unlike Embodiments 1 and 2, which include the respective terminal-equipped outer core components 328A and 328B into which the terminal fittings 8A are integrated during molding of the side resin-molded portion 328*m*, the reactor 1C of Embodiment 3 includes a terminal-equipped outer core component 328C to which terminal fittings 8C are fixed by a resin composing the side resin-molded portion 328*m* after molding of the side resin-molded portion 328*m* and which thus holds the terminal fittings 8C. Hereinafter, this difference will be mainly described, and a description of the configurations and effects that are the same as those of Embodiments 1 and 2 is omitted.

Terminal-Equipped Outer Core Component

The terminal-equipped outer core component 328C provided in the reactor 1C includes a fixing portion that is formed of the resin composing the side resin-molded portion 328*m* and that holds the terminal fittings 8C. In this example, the fixing portion includes shaft portions 3282 (FIGS. 9 and 10) that are inserted into cylindrical fixing holes 82*h* provided in the respective terminal fittings 8C and head portions 3283 that are provided extending continuous with the respective shaft portions 3282 and that each have a portion larger than the diameter of the fixing holes 82*h*. The shaft portions 3282 and the head portions 3283 are, so to speak, shafts and heads of rivets, and the terminal fittings 8C are fixed by riveting. Furthermore, in this example, the terminal-equipped outer core component 328C includes protrusions (rotation preventing protrusions 3284) that are formed of the resin composing the side resin-molded portion 328*m* and that are respectively inserted into separate two through holes (fixing holes 84*h*) provided in each of the terminal fittings 8C. The fixing holes 84*h* and the protrusions 3284 together function as a rotation preventing portion that prevents rotation of the corresponding terminal fitting 8C and also function as the fixing portion. That is to say, the terminal fitting 8C is latched by the shaft portion 3282 and the protrusions 3284 that are inserted into the fixing holes 82*h* and 84*h*, and is prevented from being detached (disconnected) from the shaft portion 3282 and the protrusions 3284 by the head portion 3283 and furthermore is prevented from rotating. Such a fixing portion allows the terminal-equipped outer core component 328C to firmly hold the terminal fittings 8C similarly to, for example, the terminal-equipped outer core component 328A of Embodiment 1.

Figure 9:
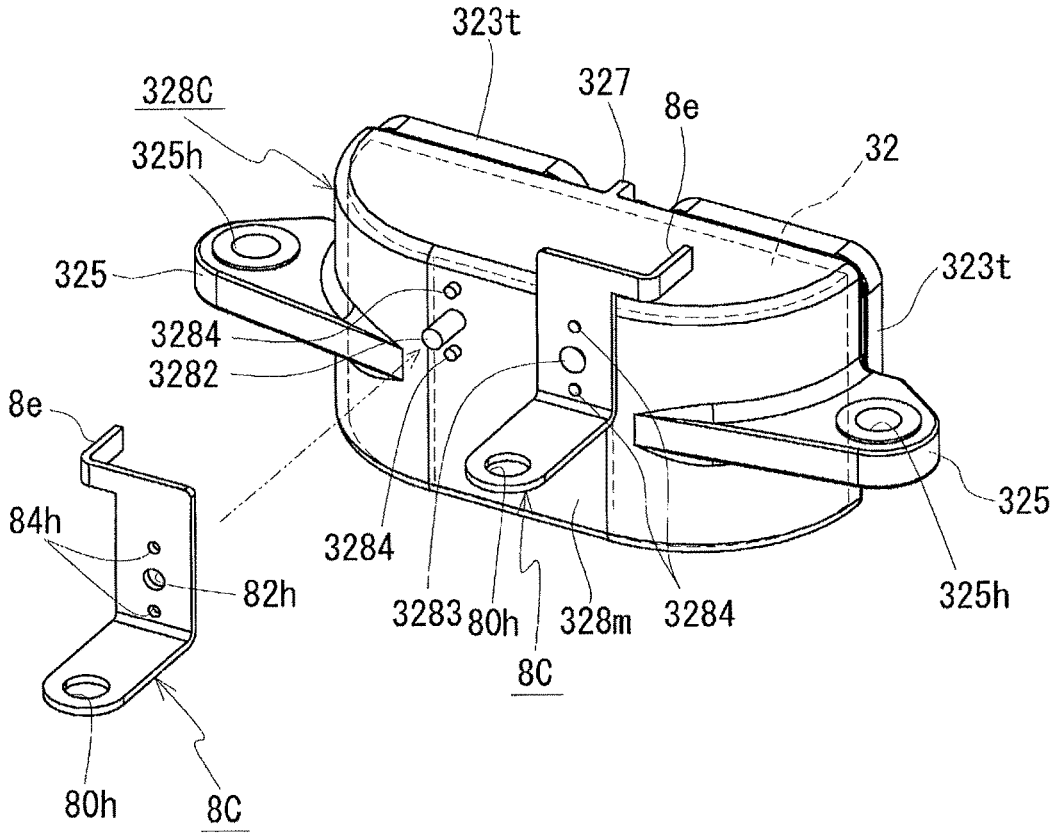
FIG. 9 is an explanatory diagram for explaining a procedure for fixing a terminal fitting in a terminal-equipped outer core component included in the reactor of Embodiment 3.

In this example, the terminal fittings 8C each include three cylindrical holes in the above-described intermediate region, the three cylindrical holes being arranged one above the other in the up-down direction (FIG. 9). One cylindrical hole (here the middle hole) of the three cylindrical holes serves as the fixing hole 82*h* used for the above-described riveting, and the two upper and lower cylindrical holes sandwiching the fixing hole 82*h* serve as the fixing holes 84*h* used for the rotation preventing portion for the terminal fitting 8C. In this example, the diameter of the fixing hole 82*h* used for riveting is larger than the diameter of the other two fixing holes 84*h*; however, the three cylindrical holes can have equal diameters or can all have different diameters. When the fixing holes 82*h* and 84*h* are cylindrical holes, these holes can be easily formed by punching with a punch or drilling or the like (this point also holds true for a fixing hole 86*h* of Embodiment 4, which will be described later).

Figure 8:
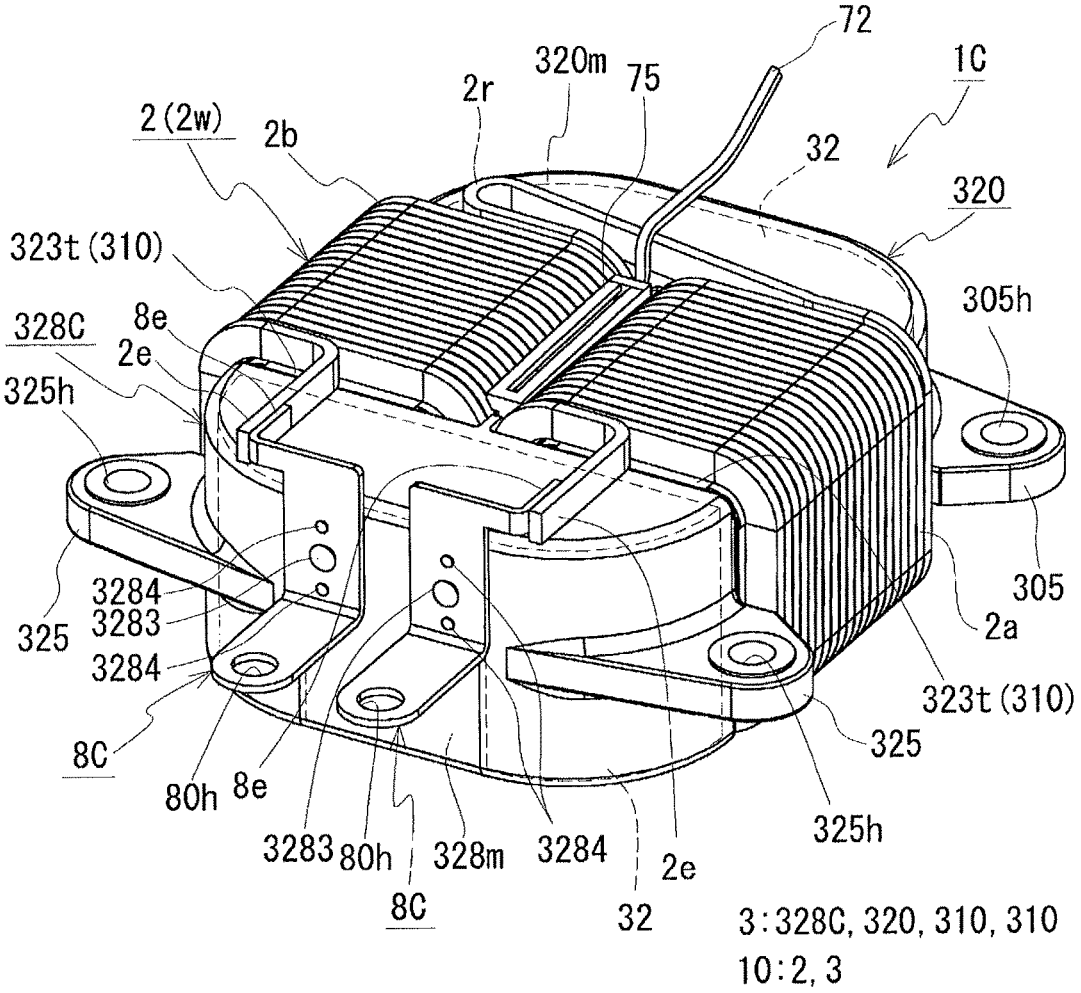
FIG. 8 is a schematic perspective view showing a reactor of Embodiment 3.

In this example, the side resin-molded portion 328*m* includes the rotation preventing protrusion 3284, the shaft portion 3282 and the head portion 3283, as well as the rotation preventing protrusion 3284, which are formed of the resin composing the side resin-molded portion 328*m* and arranged one above the other in the up-down direction, corresponding to the above-described three cylindrical holes that are arranged one above the other (FIGS. 8 and 9). The shaft portion 3282 and the protrusions 3284 have circular column shapes that are similar to the inner circumferential shapes of the cylindrical fixing holes 82*h* and 84*h* (FIG. 9), and in accordance with the inner diameters of the fixing holes 82*h* and 84*h*, the outer diameter of the shaft portion 3282 is larger than the outer diameter of the protrusions 3284. The thick shaft portion 3282 makes it easy to form the head portion 3283 by melting an end portion of the shaft portion 3282 as described later and also makes it possible to form a sufficiently large head portion 3283. Although the external shapes (outer circumferential shapes) of the shaft portion 3282 and the protrusions 3284 can be dissimilar to the inner circumferential shapes of the fixing holes 82*h* and 84*h*, if the shaft portion 3282 and the protrusions 3284 have circular column shapes that are similar to the shapes of the cylindrical holes, superior moldability is obtained.

Since a set of the fixing hole 82*h* and the fixing portion (shaft portion 3282 and head portion 3283) will suffice to fix the terminal fitting 8C, the fixing holes 84*h* and the rotation preventing protrusions 3284 can be omitted. However, as shown in this example, it is preferable to further include the fixing holes 84*h* and the protrusions 3284 because this makes it possible to prevent rotation of the terminal fitting 8C around the shaft portion 3282 even when the fixing hole 82*h* is a cylindrical hole and to stably maintain the position of the terminal fitting 8C. Moreover, the fixing holes 84*h* and the protrusions 3284 are likely to improve the positioning accuracy and the fixed state of the terminal fitting 8C. When the fixing hole 82*h* is a cylindrical hole, the terminal fitting 8C may rotate even if the shaft portion 3282 has a non-circular-column shape, and therefore it is preferable to include the rotation preventing portion.

As long as the terminal fitting 8C can be prevented from rotating, the shape, arrangement position, number, and the like of the fixing holes 84*h* and the rotation preventing protrusions 3284 can be changed as appropriate. For example, the above-described fixing hole 82*h* and the fixing portion (3282, 3283) may also be arranged side-by-side or arranged in a triangle, instead of being arranged one above the other. Moreover, it is also possible to include only one set, or three or more sets, of the fixing hole 84*h* and the protrusions 3284.

Manufacturing Method

Next, a method for manufacturing the terminal-equipped outer core component 328C will be described. First, as shown in FIG. 9, the terminal fittings 8C in each of which the fixing holes 82*h* and 84*h* having predetermined sizes and shapes are formed at predetermined positions are prepared. Also, a core molded product in which the side main portion 32 is covered by the side resin-molded portion 328*m* and the shaft portions 3282 and the rotation preventing protrusions 3284 having predetermined sizes and shapes are integrally molded at predetermined positions on the resin-molded portion 328*m* is prepared using insert molding or the like.

In this configuration, the resin composing the side resin-molded portion 328*m* may be a resin that can be melted, for example, a thermoplastic resin such as PPS. This enables melting of the end portion of each shaft portion 3282 used for riveting as described above.

Figure 10:
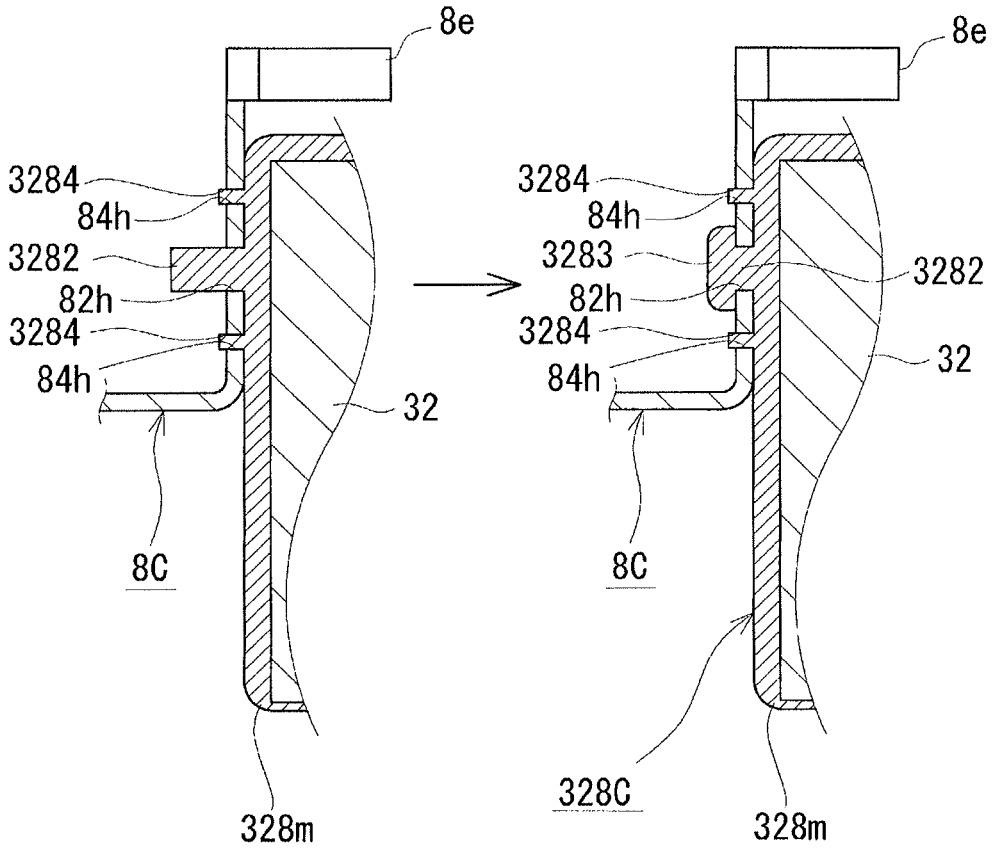
FIG. 10 is a partial cross-sectional view showing the vicinity of a terminal fitting and a fixing portion, of the terminal-equipped outer core component included in the reactor of Embodiment 3, before and after the terminal fitting is fixed.

The protruding height of each shaft portion 3282 is set to such a height that allows the end portion of the shaft portion 3282 to sufficiently protrude from the fixing hole 82*h* when inserted into the fixing hole 82*h* of the terminal fitting 8C (see illustration on the left side in FIG. 10). This enables a head portion 3283 having a sufficient size to be formed by melting the end portion of the shaft portion 3282. There is no particular limitation on the protruding height of each rotation preventing protrusion 3284 as long as the terminal fitting 8C can be prevented from rotating when the rotation preventing protrusion 3284 is inserted into the corresponding fixing hole 84*h* of the terminal fitting 8C. For example, any of the heights that allow the end portion of the rotation preventing protrusion 3284 to slightly protrude from the fixing hole 84*h*, to be substantially flush with the surface of the terminal fitting 8C, or to not protrude from the fixing hole 84*h* when inserted into the fixing hole 84*h* of the terminal fitting 8C can be used.

Then, the shaft portion 3282 and the rotation preventing protrusions 3284 of the prepared core molded product are inserted into the corresponding fixing holes 82*h* and 84*h* of the terminal fitting 8C. In this example, in the inserted state, the end portion of the protrusion 3284, the end portion of the shaft portion 3282, and the end portion of the protrusion 3284 all protrude from the fixing holes 84*h*, 82*h*, and 84*h*, respectively, of the terminal fitting 8C as shown in the illustration on the left side in FIG. 10. Here, the protruding amount of the shaft portion 3282 is set to be larger than the protruding amount of the rotation preventing protrusions 3284.

Then, the end portion of the shaft portion 3282 protruding from the fixing hole 82*h* of the terminal fitting 8C is melted to form the head portion 3283 having a portion larger than the diameter of the fixing hole 82*h* as shown in the illustration on the right side in FIG. 10. This head portion 3283 is provided protruding from the surface of the terminal fitting 8C as shown in the illustration on the right side in FIG. 10. The terminal fitting 8C is supported in such a manner that the terminal fitting 8C is held between the above-described large portion of the head portion 3283 and the resin composing the core molded product that is situated on the rear side of the terminal fitting 8C.

The terminal-equipped outer core component 328C in which the terminal fitting 8C is riveted by the resin composing the side resin-molded portion 328*m* is obtained through the above-described steps. The reactor 1C is in turn obtained by assembling the coil 2 and the core components 310 and 320 to the obtained terminal-equipped outer core component 328C in the same manner as in Embodiment 2.

Alternatively, the terminal-equipped outer core component 328C can be obtained by melting the end portion of the shaft portion 3282 and thereby fixing the terminal fitting 8C after the coil 2 and the magnetic core 3 have been assembled. However, if the terminal-equipped outer core component 328C in which the terminal fitting 8C has been fixed beforehand by melting the end portion of the shaft portion 3282 is fabricated before the coil 2 and the magnetic core 3 are assembled as described above, the end portion 8*e* of the terminal fitting 8C can be automatically disposed at the corresponding end portion 2*e* of the wire 2*w* of the coil 2 by merely assembling the coil 2 and the magnetic core 3, and thus superior assemblability is provided.

Effects of this Configuration

In the case of the reactor 1C of Embodiment 3, the terminal fittings 8C are independent of the core molded product including the side main portion 32 in the manufacturing process of the reactor 1C, but ultimately, the terminal-equipped outer core component 328C that has been integrated by the resin composing the side resin-molded portion 328*m* is assembled to the coil 2. That is to say, the number of components that are assembled into the reactor 1C can be similar to that of the reactor 1A including the terminal-equipped outer core component 328A, for example. Therefore, for the reasons (1) to (4) that have been described in Embodiment 1, the reactor 1C enables the coil 2 to be accurately connected to the terminal fittings 8C and also has excellent assemblability. Moreover, since the above-described core molded product does not include the terminal fittings 8C and has a simple external shape, the core molded product can be easily manufactured by placing the side main portion 32 in a mold and performing insert molding or the like and accordingly has excellent ease of manufacture. Furthermore, with the above-described core molded product, displacement of the terminal fittings 8C relative to the side main portion 32 does not occur during molding of the side resin-molded portion 328*m*.

Modification 3-1

An example of another configuration that can prevent the terminal fittings 8C from rotating is a configuration in which a fixing hole 82*h* is a non-circular hole (e.g., having a polygonal shape such as a triangular shape or a quadrilateral shape, or an irregular shape such as an elliptical shape), and the shaft portion of the fixing portion has a column shape column shape that is similar to the aforementioned non-circular hole. This configuration enables fixation of the terminal fittings 8C and also enables prevention of rotation even when only one fixing hole 82*h* used for riveting is provided.

Modification 3-2

An example of another configuration that can prevent the terminal fittings 8C from rotating is a configuration in which a plurality of sets of the fixing hole 82*h* and the fixing portion (shaft portion 3282 and head portion 3283) are provided. For example, head portions may be formed by melting end portions of the rotation preventing protrusions

3284 inserted into the corresponding fixing holes 84*h*. This configuration can more reliably prevent detachment using the head portions 3283 and thus allows the terminal fittings 8C to be more firmly supported, and also can prevent the terminal fittings 8C from rotating. It should be noted that if only one set used for riveting is provided as described in Embodiment 3, the number of portions to be melted can be reduced.

Modification 3-3

The case in which the fixing holes 82*h* are cylindrical holes having a uniform diameter in an axial direction thereof has been described above. It is also possible that a stepped hole (not shown) having different diameters in the axial direction thereof is used as the fixing hole. When the stepped hole is formed so that the diameter of a hole portion on a surface side of the terminal fitting 8C is larger than (increased when compared with) the diameter of a hole portion on a rear surface side (side main portion 32 side), detachment prevention and fixation can be achieved by a head portion 3283 that is formed so as to fill the larger-diameter hole portion on the surface side. In this case, there is no problem even if the head portion 3283 is formed so as to be flush with the surface of the terminal fitting 8C. However, in the case where a stepped hole is provided as well, the terminal fittings 8C can be more firmly fixed if each head portion 3283 is formed so that a portion thereof protrude from the surface of the corresponding terminal fitting 8C.

Modification 3-4

In Embodiment 3, with regard to configurations of the magnetic core 3 other than those relating to fixation of the terminal fittings 8C in the terminal-equipped outer core component 328C, the configuration in which four core components are provided as in the case of the reactor 1B of Embodiment 2 has been described. However, a configuration in which two core components are provided as in the case of the reactor 1A of Embodiment 1 can also be adopted. This also holds true for Embodiment 4, which will be described later.

Embodiment 4

In Embodiment 3, a configuration in which a portion of the side resin-molded portion 328*m* is melted to fix the terminal fittings 8C has been described. In another configuration, a reactor of Embodiment 4 can include a terminal-equipped outer core component 328D to which terminal fittings 8D are fixed by a latching portion formed of the resin composing the side resin-molded portion 328*m*. Hereinafter, the terminal-equipped outer core component 328D including the latching portion will be described in detail, and a description of the configurations and effects that are the same as those of Embodiments 1 to 3 is omitted.

Terminal-Equipped Outer Core Component

Figure 11:
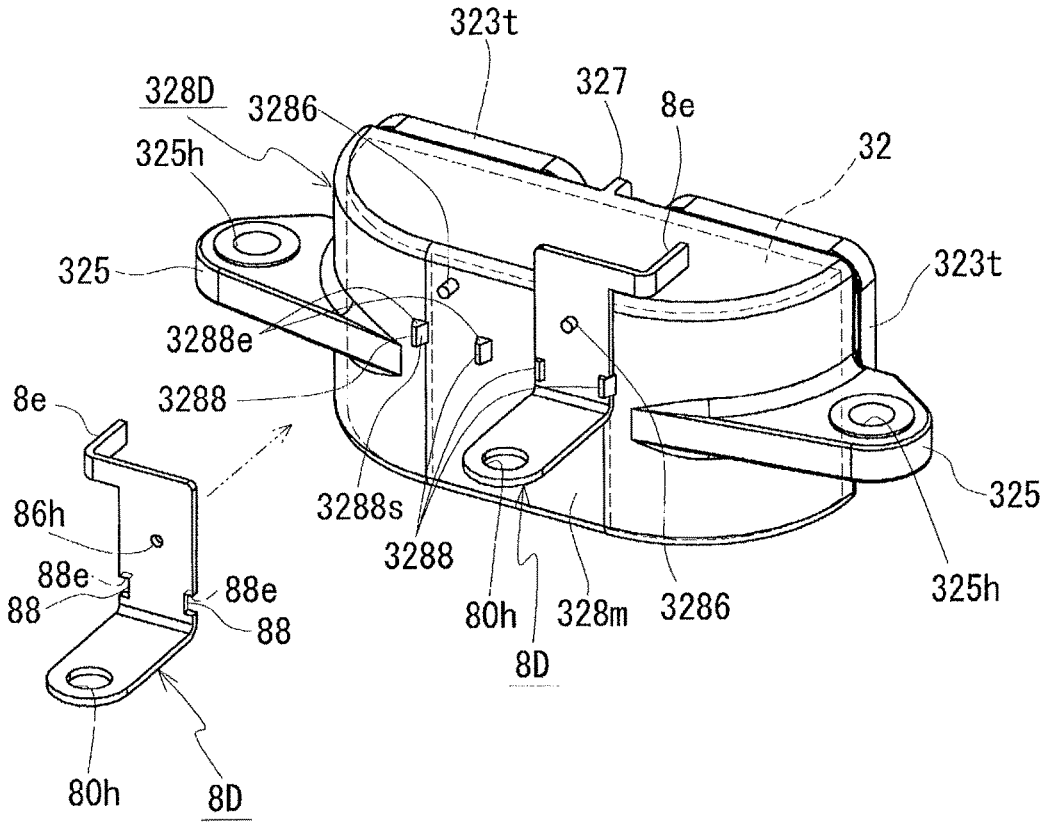
FIG. 11 is an explanatory diagram for explaining a procedure for fixing a terminal fitting in a terminal-equipped outer core component included in a reactor of Embodiment 4.

The terminal-equipped outer core component 328D shown in FIG. 11 includes the latching portion that is formed of the resin composing the side resin-molded portion 328*m* and that holds the terminal fittings 8D. In this example, the latching portion includes a portion (clamping protrusions 3288) that mechanically holds the corresponding terminal fitting 8D by the terminal fitting 8D being fitted and pressed therebetween.

More specifically, the latching portion includes a latching protrusion 3286 that is inserted into the fixing hole 86*h* provided in the corresponding terminal fitting 8D and two clamping protrusions 3288 that clamp respective notches 88 from both sides, the notches 88 being provided at opposite edges of the terminal fitting 8D. The terminal fitting 8D is latched by the latching protrusion 3286 inserted into the fixing hole 86*h*, and is also prevented from being detached (disconnected) from the protrusion 3286 and rotating by the clamping protrusions 3288 holding the opposite edges of the terminal fitting 8D while engaging the respective notches 88. With this latching portion, the terminal-equipped outer core component 328D firmly holds the terminal fittings 8D like the terminal-equipped outer core component 328A of Embodiment 1, for example.

In this example, the terminal fittings 8D each have a single cylindrical hole in the above-described intermediate region and rectangular cut-away portions at the opposite edges of a central region, and the cylindrical hole serves as the fixing hole 86*h* and the cut-away portions serve as the notches 88. The shape and size of the fixing hole 86*h* as well as the shape and size of the notches 88 can be changed as appropriate. In this example, the external shape (outer circumferential shape) of the latching protrusion 3286 provided on the side resin-molded portion 328*m* is a circular column shape that is similar to the inner circumferential shape of the fixing hole 86*h*, but the external shape of the latching protrusion 3286 may also be dissimilar to the inner circumferential shape of the fixing hole 86*h*.

In this example, the clamping protrusions 3288 each have a rectangular column shape, and opposing surfaces of the two protrusions 3288 are sloping surfaces 3288*s*. The sloping surfaces 3288*s* individually slope so that the distance between the protrusions 3288 decreases from an outward side of an opening therebetween toward the side main portion 32 side (the opening is wide on a free end side of the protrusions 3288 and narrow on a fixed end side). The minimum distance between the protrusions 3288 is slightly smaller than the distance between the notches 88 provided in the terminal fitting 8D. The shapes of the fixing hole 86*h* and the protrusions 3286 and 3288 shown in this example are merely an example, and can be changed as appropriate.

With respect to the terminal fitting 8D that has been fitted between the above-described clamping protrusions 3288, the region between the notches 88 is clamped between the protrusions 3288 in a press-fitted state, and edge surfaces 88*e* of the respective notches 88 are supported by upper end surfaces 3288*e* of the protrusions 3288. Furthermore, although the terminal fittings 8D may rotate when fixed by only the fixing holes 86*h* and the latching protrusions 3286, the rotation is prevented by the clamping protrusions 3288. In this manner, when the terminal fittings 8D are latched by the latching protrusions 3286 and clamped by the clamping protrusions 3288 from both sides, the terminal fittings 8D are accurately positioned and fixed with their positions in the up-down direction and the left-right direction being restricted.

Manufacturing Method

Next, a method for manufacturing the terminal-equipped outer core component 328D will be described. The terminal fittings 8D in each of which the fixing hole 86*h* and the notches 88 having predetermined sizes and shapes are formed at predetermined positions are prepared. Also, a core molded product in which the side main portion 32 is covered by the side resin-molded portion 328*m* and the latching protrusions 3286 and the clamping protrusions 3288 having predetermined sizes and shapes are integrally formed at predetermined positions on the resin-molded portion 328*m* is prepared using insert molding or the like.

Unlike Embodiment 3, in this configuration, the side resin-molded portion 328*m* is not melted to fix the terminal fittings 8D. For this reason, the resin composing the resin-molded portion 328*m* may also be a thermosetting resin or the like or may be a thermoplastic resin.

It is sufficient if the protruding height of each latching protrusion 3286 is set to such a height that allows the corresponding terminal fitting 8D to be latched when the latching protrusion 3286 is inserted into the fixing hole 86*h* of the terminal fitting 8D. The protruding height may be any of the heights that allows the end portion of the protrusion 3286 to slightly protrude from the fixing hole 86*h*, to be substantially flush with the surface of the terminal fitting 8D, or to not protrude from the fixing hole 86*h*.

Then, the latching protrusion 3286 of the prepared core molded product is inserted into the fixing hole 86*h* of the terminal fitting 8D, and the notches 88 are fitted between the clamping protrusions 3288. The notches 88 can be fitted by using elastic deformation of the resin composing the side resin-molded portion 328*m*. The latching protrusion 3286 and the sloping surfaces of the clamping protrusions 3288 also function as a guide during attachment of the terminal fitting 8D.

The terminal-equipped outer core component 328D onto which the terminal fittings 8D are mechanically latched by the resin composing the side resin-molded portion 328*m* is obtained through the above-described steps. The reactor of Embodiment 4 is obtained by assembling the thus obtained terminal-equipped outer core component 328D to the coil 2 and the core components 310 and 320 (FIG. 6) in the same manner as in Embodiment 2.

Effects of this Configuration

In the reactor of Embodiment 4, the terminal fittings 8D are independent of the core molded product including the side main portion 32 in the manufacturing process of the reactor, but ultimately, the terminal-equipped outer core component 328D that has been integrated by the resin composing the side resin-molded portion 328*m* is assembled to the coil 2. That is to say, the number of components assembled into the reactor of Embodiment 4 can be similar to that of the reactor 1A including the terminal-equipped outer core component 328A, for example. Therefore, for the reasons (1) to (4) described in Embodiment 1, the reactor of Embodiment 4 enables the coil 2 to be accurately connected to the terminal fittings 8D and also has excellent assemblability. Moreover, the above-described core molded product does not include the terminal fittings 8D and thus has excellent ease of manufacture. Moreover, no heating step such as melting is required to integrate the terminal fittings 8D and the core molded product together. It is expected that the reactor of Embodiment 4 can be used, for example, in the case where the terminal fittings 8D have a short overall length and thus is unlikely to resonate during vibration or in the case where the strength of connection between the coil 2 and the installation target is sufficiently high.

Modification 4-1

It is also possible that at least one of the clamping protrusions 3288 has a hook shape (such as an L-shape extending to a front surface of the terminal fitting D around a side surface thereof). In this case, detachment of the terminal fitting 8D (detachment toward an outward side of the side main portion 32, detachment in a direction toward the front side of the paper plane in FIG. 11) can be more effectively prevented. The hook-shaped protrusion can be formed by performing a process such as molding, cutting, or the like.

Embodiment 5

In Embodiment 2, a configuration in which both of the junction layer 62 and the heat dissipation plate 6 are provided has been described. As a reactor of Embodiment 5, a configuration in which only the junction layer 62 is provided can be adopted. It is expected that this configuration also enables stable fixation to the installation target, an improvement in the heat dissipation properties, and the like if the junction layer 62 is provided over substantially the entire installation surface of the coil 2 and furthermore over substantially the entire installation surface of the reactor. It is preferable if a mold release material is attached to the surface of the junction layer 62 until the reactor according to Embodiment 5 is joined to the installation target, because the surface of the junction layer 62 can be kept clean. The mold release material can be detached during installation of the reactor of Embodiment 5 on the installation target, and a solidification (curing) process (which may be unnecessary in some cases) appropriate for the adhesive can be performed.

The reactor of Embodiment 5 includes the junction layer 62, and thus sufficient fixation to the installation target can be achieved even if fastening or the like using the above-described bolts 45 is omitted. Moreover, with the reactor of Embodiment 5, the coil 2 can be fixed to the installation target by the junction layer 62, and thus, even if the coil 2 is subjected to vibration and the like during use, behaviors such as elongation/contraction of the coil 2, rubbing of turns of the coil 2 against each other, and the like can be prevented. Furthermore, if the coil elements 2*a* and 2*b* are rectangular tube-shaped edgewise coils, it is easy to secure a large contact area between the installation surface of the coil 2 and the installation target as described above, and the coil 2 can be sufficiently fixed to the installation target using the junction layer 62. The configuration that includes the junction layer 62, and the configuration that further includes the heat dissipation plate 6 are also applicable to Embodiments 3 and 4 described above and Embodiments 6 to 8, which will be described below.

Embodiment 6

In Embodiment 2, the cooling case 4 integrally provided in the convertor case has been described as an object that houses the reactor 1B. As a reactor of Embodiment 6, a configuration in which a cooling case 4 that is independent of the converter case and that is attached to the converter case is provided can be adopted.

Embodiment 7

In Embodiment 1, a configuration in which an I-shaped core component (terminal-equipped outer core component 328A) and a U-shaped core component (U-shaped core component 30U) are provided has been described. In Embodiments 2 to 4, configurations in which a plurality of I-shaped core components (inner core components 310 and outer core components 328A, 328B, 328C, 328D, and 320) are provided have been described. In addition to those configurations, as a reactor of Embodiment 7, a configuration in which a terminal-equipped L-shaped core component obtained by covering one of the middle main portions 31 and one of the side main portions 32 with a resin-molded portion in a state in which these two main portions have been assembled into an L-shape as well as an L-shaped core component obtained by covering the other middle main portion 31 and the other side main portion 32 with a resin-molded portion in a state in which these two main portions have been assembled into an L-shape are provided can be adopted. That is to say, a configuration in which the magnetic core 3 includes a total of two L-shaped core components can be adopted.

Embodiment 8

In Embodiments 1 to 7, configurations in which all of the main constituent components of the magnetic core 3 include a resin-molded portion have been described. In addition to those configurations, as a reactor of Embodiment 8, a configuration in which a magnetic core has a portion including no resin-molded portion can be adopted. That is to say, for example, the reactor of Embodiment 8 may include the coil 2 shown in FIG. 6 etc., any of the terminal-equipped outer core components 328A to 328D, and the middle main portions 31 and the other side main portion 32 shown in FIG. 3, or may include the coil 2 shown in FIG. 6 etc., the above-described terminal-equipped L-shaped core component, and the other middle main portion 31 and the other side main portion 32 shown in FIG. 3. All of these configurations have a portion that does not require formation of a resin-molded portion and thus have excellent ease of manufacture of the magnetic core.

With respect to the reactor of Embodiment 8, for example, in the case where the other side main portion 32 having no resin-molded portion is composed of the above-described composite material, depending on the manufacturing conditions (for example, settling a magnetic component having a higher specific gravity than the resin, etc.) of the composite material, a surface resin layer substantially formed of a resin component in the composite material can be provided. In this case, the surface resin layer (the above-described ceramics may be contained) can be expected to protect the magnetic component from the environment and also can be expected to have a corrosion inhibiting effect and other effects even when a separate resin coating is not provided. Since the middle main portions 31 are covered by the coil 2, it can be expected that the corrosion inhibiting effect and other effects are provided by the coil 2 to some extent, irrespective of the composition of the magnetic core and the presence/absence of resin.

With the reactor of Embodiment 8, if a separate insulator (not shown) is interposed between the coil 2 and the portion of the magnetic core 3 that has no resin-molded portion, the insulation between the coil 2 and the magnetic core 3 can be enhanced, and displacement of the positions of the coil 2 and the magnetic core 3 relative to each other can be less likely to occur. An insulator having an appropriate shape can be used as the insulator, and for example, a configuration in which a tube-shaped portion that is disposed on an outer circumference of the middle main portion 31 and a frame-like portion that is disposed between the other side main portion 32 and an end surface of the coil 2 are provided may be adopted. Examples of the constituent material of the insulator include the various types of thermoplastic resins that have been mentioned in the section "Constituent Material of Resin-Molded Portion".

Embodiment 9

The reactors 1A to 1C and the like of Embodiments 1 to 8 can be preferably applied to uses where the energization conditions are, for example, maximum current (direct current): about 100 A to 1000 A, average voltage: about 100 V to 1000 V, and used frequency: about 5 kHz to 100 kHz. As exemplary examples of such uses, the reactors 1A to 1C and the like of Embodiments 1 to 8 can be preferably used for a component for use in automobiles, such as a constituent component of a converter installed in an electric automobile, a hybrid automobile, or the like or a constituent component of a power conversion device including this converter. Hereinafter, an example in which the reactor 1A of Embodiment 1, for example, is applied to a power conversion device for use in automobiles will be briefly described with reference to FIGS. 12 and 13.

Figure 12:
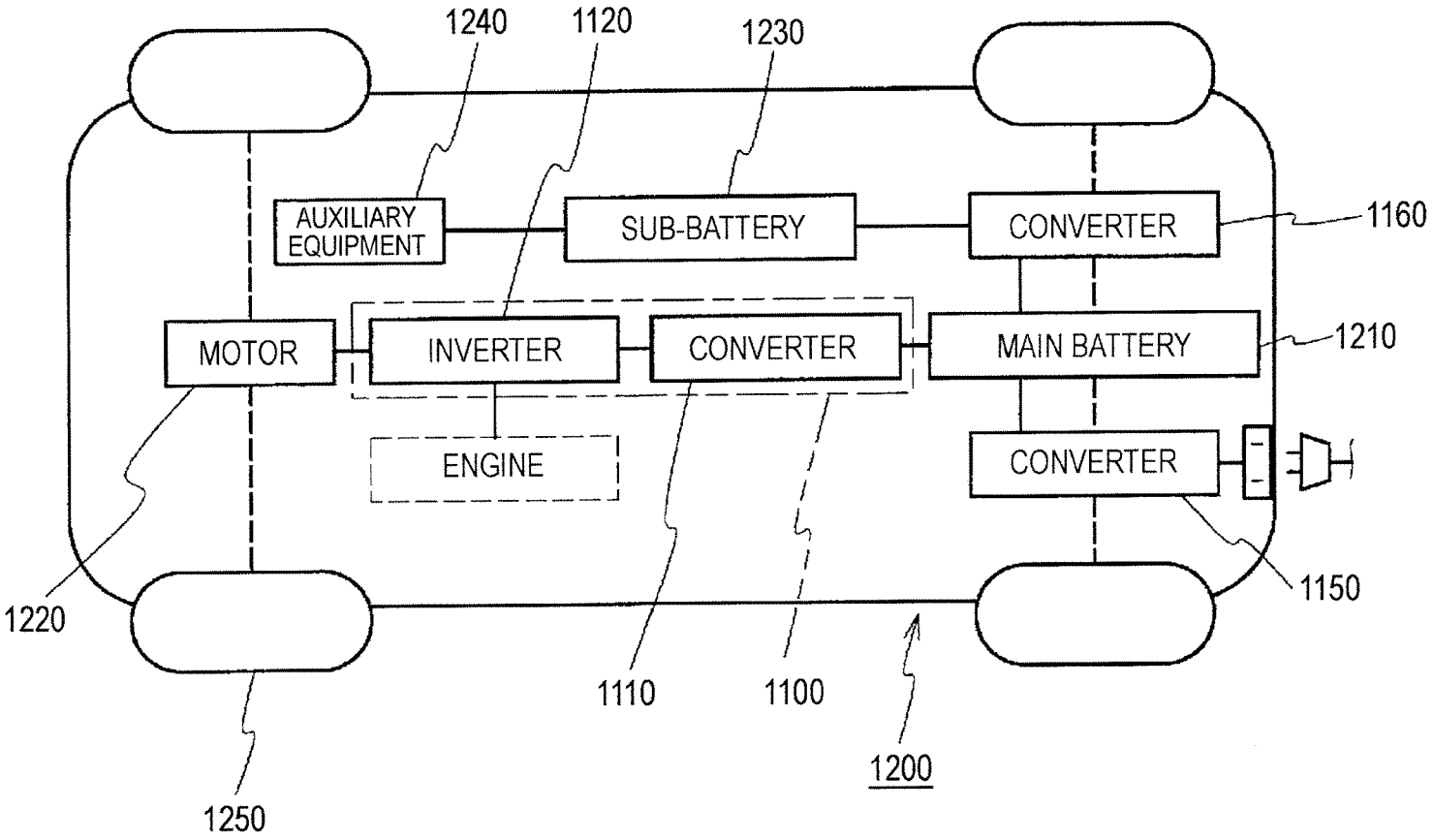
FIG. 12 is a schematic configuration diagram schematically illustrating a power supply system for a hybrid automobile.

For example, a vehicle 1200 such as a hybrid automobile or an electric automobile includes, as shown in FIG. 12, a main battery 1210, a power conversion device 1100 connected to the main battery 1210, and a motor (load) 1220 that is driven by power supplied from the main battery 1210 and that is used for travelling. The motor 1220, which may typically be a three-phase alternating current motor, drives wheels 1250 during travelling, and functions as a generator during regeneration. In the case of a hybrid automobile, the vehicle 1200 includes an engine in addition to the motor 1220. It should be noted that although FIG. 12 shows an inlet as a portion for charging the vehicle 1200, a configuration in which a plug is provided can also be adopted.

The power conversion device 1100 has a converter 1110 that is connected to the main battery 1210 and an inverter 1120 that is connected to the converter 1110 and that converts direct current to alternating current and vice versa. During travelling of the vehicle 1200, the converter 1110 shown in this example increases the direct current voltage (input voltage), about 200 V to 300 V, of the main battery 1210 to about 400 V to 700 V, thereby feeding power to the inverter 1120. Also, during regeneration, the converter 1110 decreases a direct current voltage (input voltage) output from the motor 1220 via the inverter 1120 to a direct current voltage suitable for the main battery 1210, thereby charging the main battery 1210. During travelling of the vehicle 1200, the inverter 1120 converts direct current whose voltage has been increased by the converter 1110 to a predetermined alternating current, thereby feeding power to the motor 1220, while during regeneration, an alternating current output from the motor 1220 is converted to direct current, which in turn is output to the converter 1110.

Figure 13:
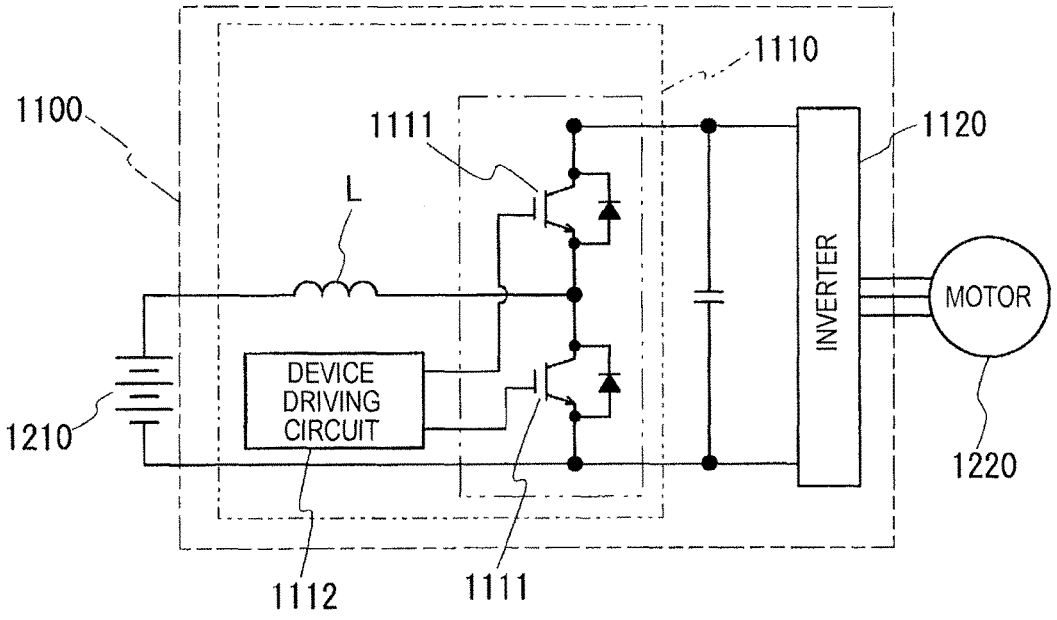
FIG. 13 is a schematic circuit diagram illustrating an example of a power conversion device including a converter.

The converter 1110 includes, as shown in FIG. 13, a plurality of switching elements 1111, a driving circuit 1112 that controls the operation of the switching elements 1111, and a reactor L, and converts an input voltage (here, increases and decreases the voltage) by repeatedly turning ON/OFF (switching operation). A power device such as a field-effect transistor (FET) or an insulated gate bipolar transistor (IGBT) may be used as the switching elements 1111. The reactor L utilizes the property of the coil inhibiting a change in current attempting to flow through the circuit, and has the function of smoothing any change in current when current is about to increase or decrease due to the switching operation. The reactors 1A to 1C and the like of Embodiments 1 to 8 above may be provided as this reactor L. In particular, in the case where the cooling case 4 into which the liquid coolant 4L can be supplied is provided within the converter 1110, a structure having also excellent heat dissipation properties can be easily formed by the assembled body 10 and the like of the reactor 1A, 1B, or 1C being housed in this case 4. Since the power conversion device 1100 or the converter 1110 includes the reactor 1A, 1B, or 1C that enables the coil 2 to be accurately connected to the terminal fittings 8A or the like and that also has excellent assemblability, a structure that enables the coil 2 to be accurately connected to the terminal fittings 8A or the like and also has excellent assemblability, and furthermore, has excellent heat dissipation properties as described above can be obtained.

It should be noted that the vehicle 1200 includes, in addition to the converter 1110, a converter 1150 for a power feeding device, the converter 1150 being connected to the main battery 1210, and a converter 1160 for an auxiliary equipment power supply, the converter 1160 being connected to a sub-battery 1230, which serves as a power source for auxiliary equipment 1240, and the main battery 1210 and converting a high voltage of the main battery 1210 to a low voltage. The converter 1110 typically performs DC-DC conversion, whereas the converter 1150 for the power feeding device and the converter 1160 for the auxiliary equipment power supply perform AC-DC conversion. There are also converters 1150 for the power feeding device that performs DC-DC conversion. A reactor having the same configuration as the reactors 1A to 1C and the like of Embodiments 1 to 8 above, with the size, shape, and the like of the reactor being changed as appropriate, can be used as reactors for the converter 1150 for the power feeding device and the converter 1160 for the auxiliary equipment power supply. Moreover, the reactors 1A to 1C and the like of Embodiments 1 to 8 above can also be used for a converter that converts the input power and only increases or only decreases the voltage.

It should be noted that the present invention is not limited to the above-described examples, but rather is defined by the appended claims, and all changes that come within the meaning and range of equivalency of the claims are therefore intended to be embraced therein. For example, it is possible that the reactor has only one coil element. Also, for example, a coil molded component in which a resin-molded portion is formed on an outer circumference of the coil can be employed as a constituent element. Furthermore, a core-coil-molded component in which at least one middle main portion and the coil are integrally held by a resin-molded portion or a U-shaped core-coil-molded component in which the pair of middle main portions, the other side main portion, and the coil are integrally held by a resin-molded portion can be employed as a constituent element. In those configurations that include these core-coil-molded bodies, the number of components is small, and the assemblability is even more excellent.

INDUSTRIAL APPLICABILITY

LIST OF REFERENCE NUMERALS

1A, 1B, 1C: Reactor; 10: Assembled body

2: Coil

2*a*, 2*b*: Coil element; 2*r*: Connecting portion; 2*w*: Wire; 2*e*: End portion

3: Magnetic core

30U: U-shaped core component; 310: Inner core component

320: Outer core component

328A, 328B, 328C, 328D: Terminal-equipped outer core component

31: Middle main portion; 31*e*: End surface; 31*m*, 32*m*: Core piece

31*g*: Gap material

32: Side main portion; 32*e*: Inner end surface

30*m*: Connecting resin-molded portion; 310*m*: Middle resin-molded portion

320*m*, 328*m*: Side resin-molded portion

3280: Embedding and fixing portion; 3282: Shaft portion; 3283: Head portion

3284: Rotation preventing protrusion

3286: Latching protrusion; 3288: Clamping protrusion; 3288*e*: Upper end surface

3288*s*: Sloping surface

30*e*: End surface

303*s*, 323*s*: Sliding connecting portion

313*t*: Thin portion; 323*t*: Tube-shaped portion

305, 325: Attachment portion; 305*h*, 325*h*: Bolt hole

307, 327: Partitioning portion; 329: Ridge

4: Cooling case; 4L: Liquid coolant; 45: Bolt

40*i*: Inlet port; 40*o*: Outlet port; 41: Attachment surface (inner bottom surface)

42: Boss

6: Heat dissipation plate; 62: Junction layer

7: Sensor; 72: Wiring; 75: Sensor retaining member

8A, 8C, 8D: Terminal fitting; 8*e*: End portion; 80*h*: Through hole

82*h*, 84*h*, 86*h*: Fixing hole; 88: Notch; 88*e*: Edge surface

1100: Power conversion device; 1110: Converter

1111: Switching element; 1112: Driving circuit; L: Reactor

1120: Inverter

1150: Converter for power feeding device; 1160: Converter for auxiliary equipment power supply

1200: Vehicle; 1210: Main battery; 1220: Motor

1230: Sub-battery; 1240: Auxiliary equipment; 1250: Wheel

The invention claimed is:

1. A reactor comprising:

a coil formed by winding a wire about an axis; and a magnetic core having a portion disposed inside the coil, wherein the magnetic core includes a terminal-equipped outer core component, the terminal-equipped outer core component including:

a side main portion protruding from the coil and constituting a magnetic circuit;

a terminal fitting connected to an end portion of the wire;

a side resin-molded portion configured to integrally hold the side main portion and the terminal fitting, wherein:

the terminal-equipped outer core component includes a fixing portion that is formed of a resin of the side resin-molded portion and that holds the terminal fitting, the fixing portion being oriented on an external front face of the side of the side resin-molded portion, the external front face extending perpendicular to a direction parallel to the axis, and the fixing portion includes a shaft portion that is inserted into at least one fixing hole provided in the terminal fitting and a head portion that extends continuous with the shaft portion in the direction parallel to the axis, and that has a portion larger than a minimum diameter of the fixing hole, such that the terminal fitting is attached to the external front face through the shaft portion.

2. The reactor according to claim 1, wherein the terminal-equipped outer core component further includes a rotation preventing portion on the external front face of the side resin-molded portion that is formed of the resin of the side resin-molded portion and that prevents the terminal fitting from rotating.

3. The reactor according to claim 1, wherein the magnetic core forms a ring-shaped closed magnetic circuit constituted by a pair of middle main portions that are disposed inside the coil, the side main portion that connects one end of one of the middle main portions to one end of the other middle main portion, and another side main portion that protrudes from the coil and connects another end of one of the middle main portions to another end of the other middle main portion, and the magnetic core includes a connecting resin-molded portion that covers at least a portion of the other side main portion and the pair of middle main portions and that integrally holds these main portions.

4. The reactor according to claim 1, wherein the magnetic core forms a ring-shaped closed magnetic circuit constituted by a pair of middle main portions that are disposed inside the coil, the side main portion that connects one end of one of the middle main portions to one end of the other middle main portion, and another side main portion that protrudes from the coil and connects another end of one of the middle main portions to another end of the other middle main portion, and the magnetic core includes:

an outer core component including the other side main portion and a side resin-molded portion that covers at least a portion of the other side main portion; and an inner core component including the middle main portion and a middle resin-molded portion that covers at least a portion of the middle main portion.

5. The reactor according to claim 1, comprising a junction layer disposed on an installation surface of the coil.

6. The reactor according to claim 1, further comprising a center resin-molded portion disposed inside the coil so as to house the portion of the magnetic core disposed inside the coil, and the side resin-molded portion is configured to connect to the center resin-molded portion.

* * * * *